US007578081B2

(12) United States Patent
Bearden et al.

(10) Patent No.: US 7,578,081 B2
(45) Date of Patent: Aug. 25, 2009

(54) WEAR ASSEMBLY

(75) Inventors: James E Bearden, Beaverton, OR (US); Severn D Durand, Portland, OR (US); Michael A Severson, Aloha, OR (US); Christopher M Carpenter, Tualatin, OR (US)

(73) Assignee: ESCO Corporation, Portland, OR (US)

( * ) Notice: Subject to any disclaimer, the term of this patent is extended or adjusted under 35 U.S.C. 154(b) by 0 days.

(21) Appl. No.: 11/789,549

(22) Filed: Apr. 24, 2007

(65) Prior Publication Data

US 2007/0245601 A1 Oct. 25, 2007

Related U.S. Application Data

(60) Provisional application No. 60/838,313, filed on Aug. 16, 2006, provisional application No. 60/794,815, filed on Apr. 24, 2006.

(51) Int. Cl.
*E02F 9/28* (2006.01)

(52) U.S. Cl. ..... 37/455; 37/452; 37/456

(58) Field of Classification Search ..... 37/452, 37/453, 455–457

See application file for complete search history.

(56) References Cited

U.S. PATENT DOCUMENTS

| | | | | |
|---|---|---|---|---|
| 3,271,080 | A | 9/1966 | Gowanlock | |
| 3,413,739 | A | 12/1968 | Guinot | |
| 4,057,294 | A * | 11/1977 | Krekeler | 299/102 |
| 4,782,607 | A | 11/1988 | Frisbee et al. | |
| 4,823,487 | A * | 4/1989 | Robinson | 37/457 |
| 5,088,214 | A * | 2/1992 | Jones | 37/450 |
| 5,172,501 | A | 12/1992 | Pippins | |
| 5,410,826 | A | 5/1995 | Immel et al. | |
| 5,452,529 | A | 9/1995 | Neuenfeldt et al. | |
| 5,491,915 | A * | 2/1996 | Robinson | 37/458 |
| 5,564,206 | A | 10/1996 | Ruvang | |
| 5,638,621 | A | 6/1997 | Keech et al. | |
| 5,709,043 | A * | 1/1998 | Jones et al. | 37/458 |
| 5,718,070 | A * | 2/1998 | Ruvang | 37/459 |
| 5,784,813 | A | 7/1998 | Balassa et al. | |
| 5,909,962 | A | 6/1999 | Livesay et al. | |
| 5,926,982 | A | 7/1999 | Keech et al. | |
| 5,987,787 | A | 11/1999 | Mack | |
| 5,992,063 | A | 11/1999 | Mack | |
| 6,009,644 | A | 1/2000 | Hedley | |
| 6,024,143 | A | 2/2000 | Ritchey | |
| 6,108,950 | A | 8/2000 | Ruvang et al. | |
| 6,209,238 | B1 | 4/2001 | Ruvang | |

(Continued)

FOREIGN PATENT DOCUMENTS

| | | | |
|---|---|---|---|
| GB | 2111558 | A | 7/1983 |

(Continued)

*Primary Examiner*—Thomas A Beach
*Assistant Examiner*—Matthew R Buck
(74) *Attorney, Agent, or Firm*—Steven P. Schad

(57) ABSTRACT

A wear assembly for excavating equipment that includes a base, a wear part and an improved locking arrangement that provides improved stability, strength, durability, safety and ease of use. The locking arrangement includes a hammerless lock that is pivotally moved between hold and release positions, wherein the fulcrum is set forward of the bearing surface engaging the wear part. The lock can be manipulated by a threaded member or pry tool. The lock further includes bearing surfaces that enhance stability and reduce wear.

32 Claims, 17 Drawing Sheets

U.S. PATENT DOCUMENTS

| | | | | |
|---|---|---|---|---|
| 6,301,810 | B1 | 10/2001 | Fidler | |
| 6,374,521 | B1 | 4/2002 | Pippins | |
| 6,439,796 | B1 | 8/2002 | Ruvang et al. | |
| 6,491,469 | B1 * | 12/2002 | Pasqualini et al. | 403/318 |
| 6,735,890 | B2 * | 5/2004 | Carpenter et al. | 37/456 |
| 6,799,387 | B2 | 10/2004 | Pippins | |
| 6,826,855 | B2 | 12/2004 | Ruvang | |
| 6,959,506 | B2 | 11/2005 | Adamic et al. | |
| 6,993,861 | B2 * | 2/2006 | Carpenter et al. | 37/456 |
| 2001/0052196 | A1 | 12/2001 | Pippins | |
| 2002/0000053 | A1 | 1/2002 | Adamic et al. | |
| 2002/0023375 | A1 | 2/2002 | Pippins | |
| 2003/0024139 | A1 | 2/2003 | Jones et al. | |
| 2004/0060207 | A1 | 4/2004 | Livesay et al. | |
| 2004/0083630 | A1 | 5/2004 | Ruvang | |
| 2004/0237354 | A1 | 12/2004 | Emrich | |
| 2005/0028407 | A1 | 2/2005 | Ruvang et al. | |
| 2005/0229442 | A1 | 10/2005 | Jones et al. | |
| 2005/0274047 | A1 | 12/2005 | Pippins | |

FOREIGN PATENT DOCUMENTS

| | | | |
|---|---|---|---|
| JP | 200273918 | A | 10/2000 |
| JP | 2005061195 | A | 3/2005 |
| WO | WO 00/20696 | A | 4/2000 |
| WO | WO 2004/027272 | A | 4/2004 |

* cited by examiner

WEAR ASSEMBLY

FIELD OF THE INVENTION

The present invention pertains to a wear assembly for securing a wear member to excavating equipment.

BACKGROUND OF THE INVENTION

Wear parts are commonly attached along the lip of an excavating bucket or the digging edge of other excavating equipment (such as dredge cutterheads) to protect the equipment from wear and enhance the digging operation. The wear parts may be excavating teeth, shrouds, or other wear members. These assemblies typically include a base, a wear member, and a lock. The base is fixed to the digging edge, and the wear member fits over the base. The assembled base and wear member cooperatively define an opening into which the lock is received to releasably hold the wear member to the base.

Wear members for excavating equipment are commonly subjected to harsh conditions and heavy loading. Accordingly, it is desirable for the locking arrangement to be strong to effectively retain the wear member to the equipment, and also easily manipulated to permit removal and replacement of the wear member in the field. The lock is usually in the form of a pin that is driven into and out of the assembly with a large hammer. Nevertheless, many different lock arrangements have been used in the past to secure wear parts to excavating equipment with varying degrees of success.

SUMMARY OF THE INVENTION

The present invention pertains to an improved wear assembly for excavating equipment, wherein the wear member is secured by a locking arrangement having improved stability, strength, durability, safety, and ease of use.

In accordance with one aspect of the invention, the wear member has an opening with angled bearing surfaces to bear against an inserted lock for increased stability and strength, and reduced wear. In one embodiment, the bearing surfaces are inclined forward and away from the longitudinal axis in opposite lateral directions to bear against complementary surfaces in the lock.

In accordance with another aspect of the invention, the wear member has a tapering opening that defines an expanded bearing area and a narrowed anchoring area for the lock. In this construction, the wear member and the lock contact over a large surface area to transfer the applied loads while providing easy manipulation of the lock and minimizing of the overall opening size.

In accordance with another aspect of the invention, the opening in the wear member for receiving the lock is formed with at least one bearing surface and a fulcrum that are generally aligned along the longitudinal axis with the fulcrum in front of the bearing surface to provide a stable locking arrangement which is easily manipulated.

In accordance with another aspect of the invention, the wear member has an opening for receiving a hammerless lock to hold the wear member to the base. The use of a hammerless lock increases safety and the ease of using the lock. The opening is provided with at least one shoulder to prevent undue insertion and wedging of the lock into the assembly.

In accordance with another aspect of the invention, the lock generally includes a body formed with two pairs of angled bearing surfaces defining generally a diamond-shaped configuration to cooperate with complementary surfaces on the wear member and the base. This opposed orientation of bearing surfaces provides a highly stable locking arrangement for the wear assembly during use.

In accordance with another aspect of the invention, the lock includes a concave front bearing surface to grip a complementary surface on the base to resist ejection of the lock during use.

In accordance with another aspect of the invention, the lock is installed into and removed from the wear assembly in a swinging motion about a pivot axis. During removal, the lock moves along a path that causes the lock surfaces to pull away from the walls of the lock-receiving opening to lessen the resistance of impacted fines and ease removal of the lock in the field.

In accordance with another aspect of the invention, the lock is provided with a main portion and an anchoring portion. The main portion fits between opposed surfaces in the wear member and the base to prevent removal of the wear member. The anchoring portion is offset from the main portion to provide increased stability and resistance to certain loads such as pull off or vertical loads.

In accordance with another aspect of the invention, the lock includes a main portion fit between the wear member and the base, and a pivot member spaced from the main portion to swing the lock between its hold and release positions for easy use. Further, with this construction, the pivotal connection for the lock is largely shielded from high loads and abrasion during use.

In accordance with another aspect of the invention, the lock includes a coordinated latch and removal cavity to ease installation and removal. In one embodiment, the lock includes a cavity adapted to receive a tool to facilitate a hammerless removal of the lock from the assembly. The latch further includes an access opening in general alignment with the removal cavity to enable release of the latch and removal of the lock in a single operation.

In accordance with another aspect of the invention, the latch in the lock is composed of a rigid member and a resilient member. In one embodiment, the rigid and resilient members are mechanically coupled together for ease of manufacturing and/or increased strength of the coupling.

In accordance with another aspect of the invention, the wear member and lock can be coupled together to form a single, integral component for shipping and storage. In such an embodiment, the reduction of parts results in lower shipping costs, reduced storage needs, less inventory concerns and easier use. This assembly ensures the availability of a lock to secure a replacement wear member to the equipment. Also, since a new lock is included with every new wear member, the risks associated with reusing a damaged or weakened lock are eliminated. As a result, the lock is easy to use for installation and replacement of wear parts.

In another aspect of the invention, the lock is fit into a through-hole in the wear member for engagement with the base, and moved about a pivot support spaced from the through-hole. The lock cooperates with the pivot support so that the lock swings between its hold and release positions in an easy to use manner. Further, with this construction, the pivotal connection for the lock is largely shielded from high wear during use.

In another aspect of the invention, the lock is driven into and retained in a locked condition by a threaded member. The threaded member offers secure fixing of the lock in a digging operation as well as sure advancement to overcome any frictional resistance. The use of the threaded member is intuitive to the operator and easy to use.

In a further aspect of the invention, the threaded member is anchored only to the wear part without involvement with the base. As a result, there are no alignment difficulties or any need to create additional holes in the base. Moreover, the lock is easily combined with the wear member for shipping, storage and installation. In one preferred construction, the wear member is formed with a through-hole for passage of the lock to the base, and a support to anchor the threaded member to the wear member. The reliance solely on the wear member to anchor and move the lock results in an efficient, reliable, and easy system to use.

In another aspect of the invention, the base is formed with only a small groove or shoulder to engage the lock and thereby hold the wear member to the equipment. In this way, the base remains largely in tact without loss of material for receipt of the lock for a stronger and more durable construction. In one preferred example, the groove is defined along the rear end of a forwardly projecting nose.

DETAILED DESCRIPTION OF THE PREFERRED EMBODIMENTS

The present invention pertains to a wear assembly 10 (FIG. 1) for releasably attaching a wear member 12 to excavating equipment (not shown). In this application, wear member 12 is described in terms of a point or tip for an excavating tooth that is attached to a lip of an excavating bucket. However, the wear member could be in the form of other kinds of wear parts (e.g., shrouds) or attached to other excavating equipment (e.g., dredge cutterheads). Moreover, relative terms such as forward, rearward, vertical, horizontal up or down are used for convenience of explanation with reference to FIG. 1; other orientations are possible.

Figure 14:
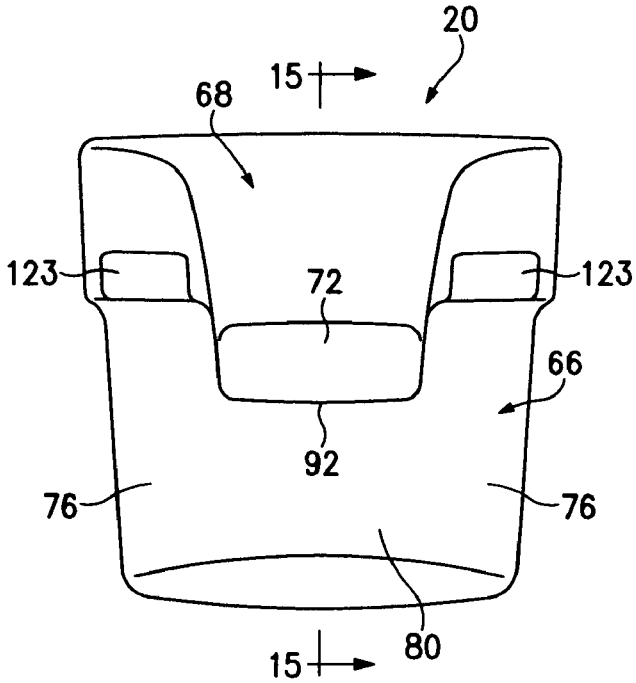
FIG. 14 is a front view of the lock.

In one embodiment, the wear member or point 12 is adapted to fit on a nose 14 (FIG. 14) of a base member 16, which in this example, is an adapter. Adapter 16 is a medial adapter which includes a rearwardly opening socket 18 to fit onto a nose of a second base (not shown). This second base is fixed to the digging edge of the bucket by welding, mechanical attachment or being integrally cast with the bucket lip. Alternatively, wear member 12 could be mounted directly to the nose that is fixed directly to the lip, without medial adapter 16. In any case, wear member 12 is releasably secured to the nose by a lock 20.

Figure 1:
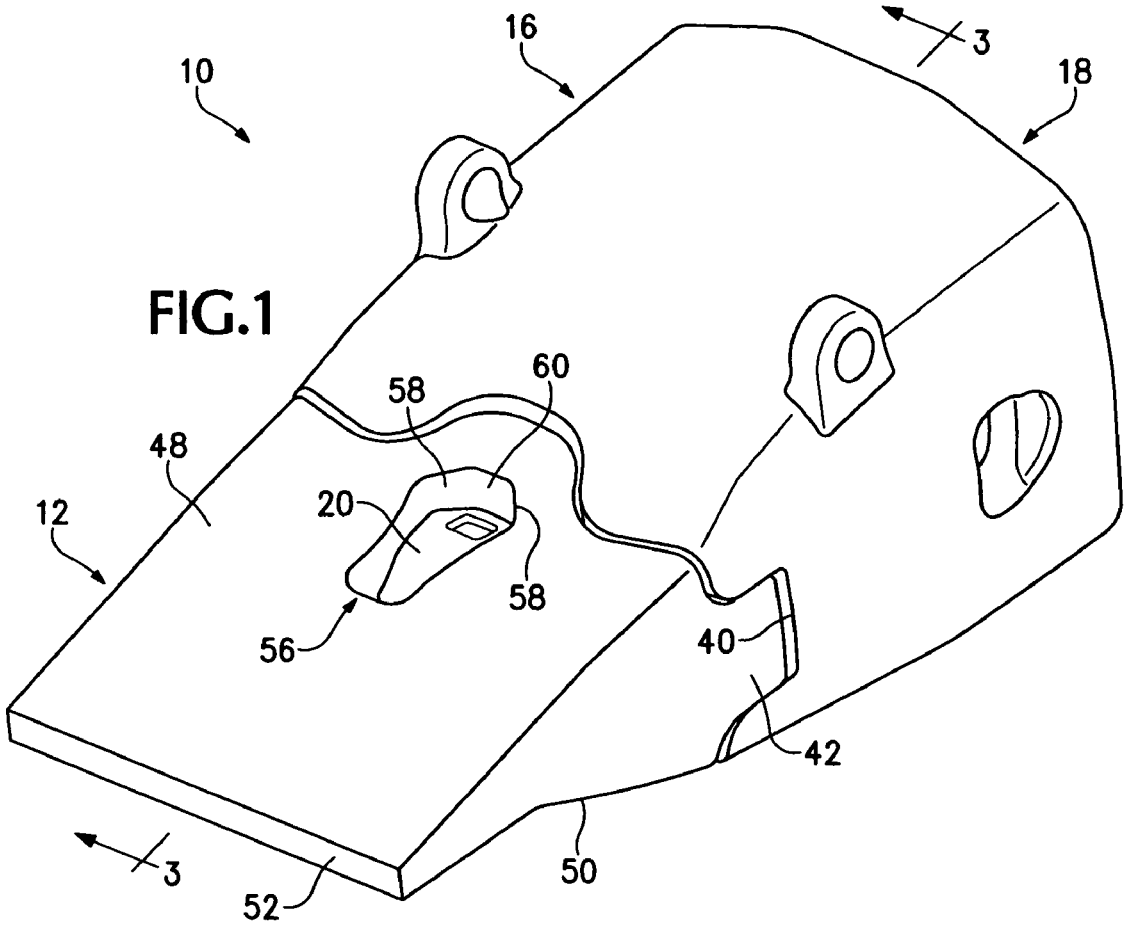
FIG. 1 is a perspective view of a wear assembly in accordance with the present invention.

In a preferred construction, nose 14 includes a front stabilizing end 21, upper and lower walls 22, 24 converging toward front end 21, and sidewalls 26 (FIGS. 2-5). A slot 28 is defined in a central portion of each of the upper and lower walls 22, 24 to define stabilizing surfaces 30, 32. Top and bottom end surfaces 34, 36 of stabilizing end 21 and stabilizing surfaces 30, 32 each preferably extends substantially parallel to the longitudinal axis 38 of adapter 16. Substantially parallel includes surfaces which are parallel or which diverge rearwardly from axis 38 at a small angle (e.g., of about 1-7 degrees) for manufacturing or other purposes. Nevertheless, surfaces 30, 32, 34, 36 could diverge from axis 38 at larger angles for some uses. A recess 40 is formed along each sidewall 26 to receive a lug 42 of point 12 (FIG. 1). Of course, a variety of changes (e.g., omitting recesses 40 and lugs 42, or changing the nose and socket configurations) could be made to the nose and point.

A cavity 44 is formed in upper stabilizing surface 30 for receiving lock 20 (FIGS. 2-5). While the cavity may be formed in lower stabilizing surface 32 or a sidewall 26, in this embodiment the cavity is formed in upper surface 30 for easier access. Cavity 44 preferably has a lower opening 44*a* for easier manufacturing and the release of fines from the cavity. Cavity 44 has a generally pentagonal-shaped inlet 45 with front angled bearing surfaces 46 each inclined to axis 38 at an angle of about 25 to 55 degrees, and most preferably at an angle of about 40 degrees. Nevertheless, the angles could be outside the preferred range. While a pentagon shape is used to provide a sufficient opening for lock 20, other shapes are possible. Further, while bearing surfaces 46 are generally linear in a lateral direction, they could also be curved.

Point 12 has a wedge-shaped configuration with upper and lower walls 48, 50 that converge toward a free end 52 for penetrating the ground (FIGS. 1-3 and 6-7). A socket 54 generally corresponding to nose 14 opens in a rear end of the point Upper wall 48 includes an opening 56 through which lock 20 is received. Opening 56 has a pair of rear angled bearing surfaces 58 to engage the lock. Surfaces 58 are preferably at an angle of about 40 to 70 degrees relative to axis 38, and most preferably at an angle of about 55 degrees, but could be set outside of the preferred range. The angle at which surfaces 58 are oriented is preferably larger than the angle for surfaces 46, but they could be the same or smaller. Although bearing surfaces are preferably linear in a lateral direction, they could also be curved. A rear end wall 60 preferably connects to the two angled bearing surfaces 58. Nevertheless, rear end wall 60 could be omitted such that bearing surfaces 58 join at a corner. Also, although not preferred in this construction, a single rear bearing surface could be used. Side surfaces 62 of opening 56 preferably taper toward front end wall 64 to minimize the overall size of the opening.

Each pair of bearing surfaces 46, 58 are angled to generally define a concave V-shape configuration facing the other pair of surfaces. As can be appreciated, the opposed angled surfaces 46, 58 generally define a diamond-shaped configuration such that the angled bearing surfaces direct the applied loads toward the central region of the main portion of lock 20. The diamond shape is a general description that could include additional linear or curved connecting surfaces between the angled bearing surfaces as well as forming strictly a diamond shape.

In an alternative construction, an opening 56 for receiving lock 20 could be included in both converging walls 48, 50 to enable reversing of the wear member on the nose and/or to permit the use of two locks; however, only a single lock on one side is needed to secure the wear member to the nose. Alternatively, reversible mounting could be achieved by providing two openings in the nose or a through-hole accessible from each side. Moreover, opening 56 could be formed in one or both of the sidewalls 51 with a corresponding cavity in the side of nose 14.

Lock 20 includes a main portion or body 66 and an anchoring portion or arm 68 (FIGS. 2-3 and 10-15). The free end 70 of arm 68 defines a pivot member 72 about which lock 20 swings between a hold position that retains wear member 12 to nose 14, and a release position which permits installation and removal of the wear member to and from the nose. In the hold position (FIGS. 1-3), body 66 is received within opening 56 and cavity 44. When released, lock 20 is withdrawn from cavity 44 and typically from assembly 10.

In this embodiment, body 66 preferably has a generally diamond-shaped cross section with rear angled bearing faces 74 to oppose angled bearing surfaces 58 in opening 56, and front angled bearing faces 76 to oppose angled bearing surfaces 46 in cavity 44 (FIGS. 2-3 and 10-15). Rear bearing faces 74 are set at an angle to correspond to the inclination of bearing surfaces 58, and front bearing faces 76 are angled to correspond to the inclination of bearing surfaces 46. In this way, the loads applied to the lock are directed inward toward a central portion of body 66 generally irrespective of whether the loads applied to wear member 12 during use have vertical or side components or are reverse loads. This arrangement causes the lock to be gripped securely between the wear member 12 and nose 14 with minimal shifting. As a result, the lock is stable and reduces wear between the components. Moreover, the use of the angled bearing surfaces tends to result in broad surface contact between the opposed surfaces 58, 74 and 46, 76 with less stress.

Lock 20 includes a rear face 78 between rear angled bearing faces 74 in opposition to rear wall 60. With new parts, rear face 78 and rear wall 60 may be spaced by a slight gap to ensure bearing pressure between surfaces 58, 74. However, after some use, rear face 78 may abut rear wall 60 under certain loads due to wearing of the components. Moreover, even when new, face 78 and wall 60 could be in abutment. Similarly, front edge 80 between front angled surfaces 76 may be spaced slightly by a gap 81 from the corresponding front portion 82 in cavity 44 to ensure contact between surfaces 46, 76 when the components are new. These surfaces, though, may abut in time, and they could also be formed to abut when new. Of course, variations in the shape of the lock 20, cavity 44 and opening 56 could be used. For example, surfaces 58, 74 could extend to a corner like surfaces 46, 76, or a connecting wall could be provided between surfaces 46, 76. Connecting walls could also be provided between adjacent surfaces 74, 76 and the corresponding surfaces in cavity 44 and opening 56.

Figure 2:
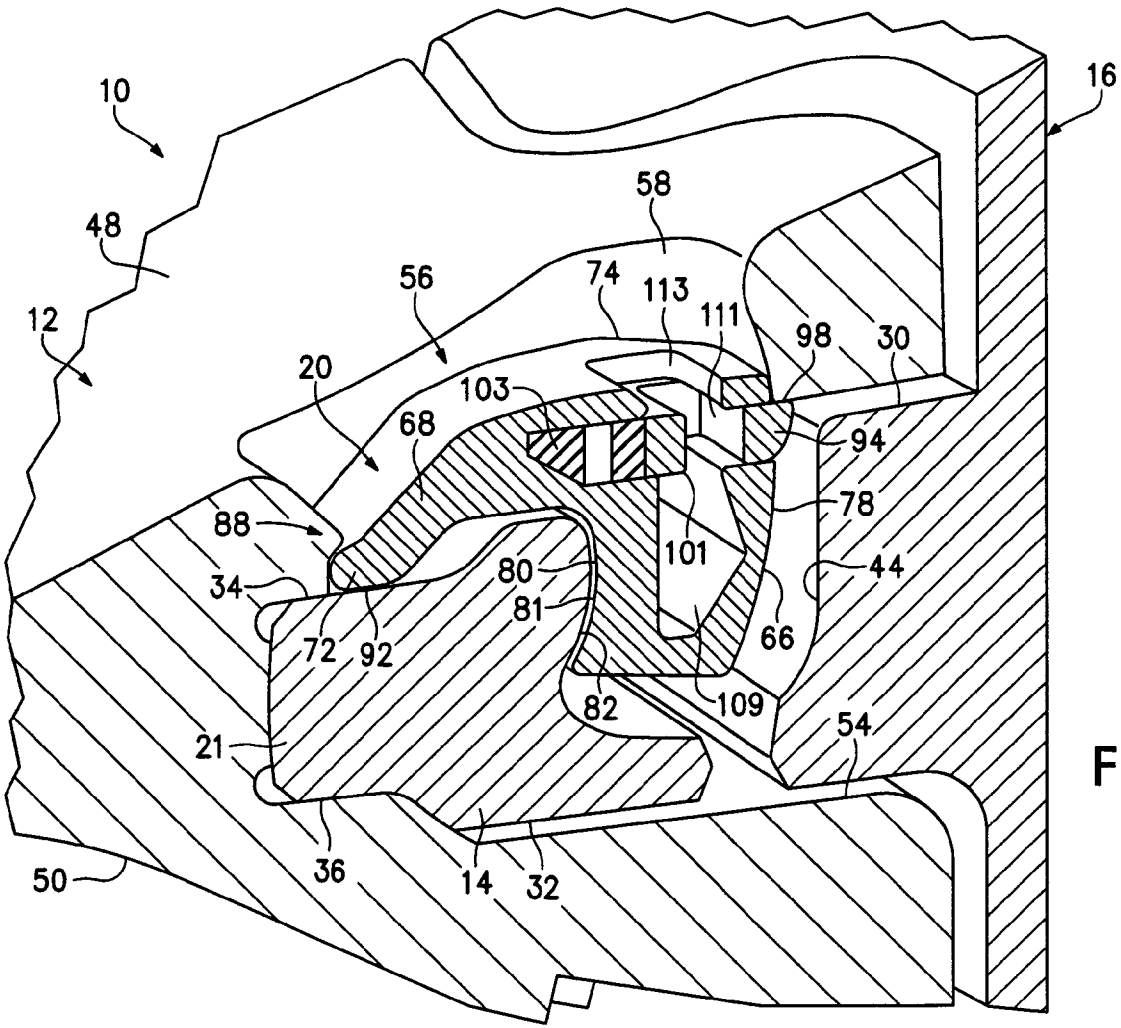
FIG. 2 is a partial perspective view with the assembly cut along the longitudinal axis of the wear assembly.
Figure 3:
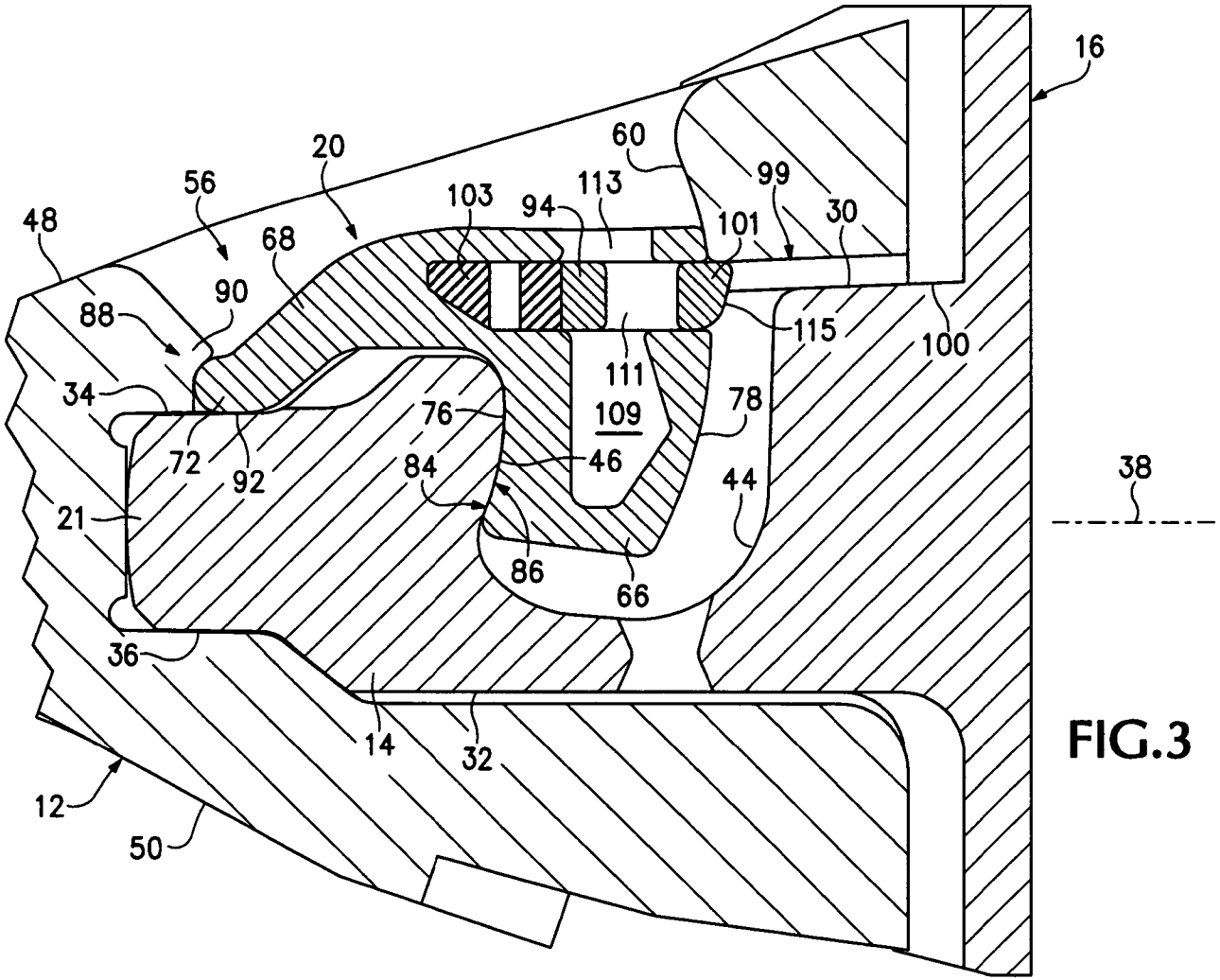
FIG. 3 is a cross-sectional view along line 3-3 in FIG. 1, which is off the longitudinal axis.
Figure 4:
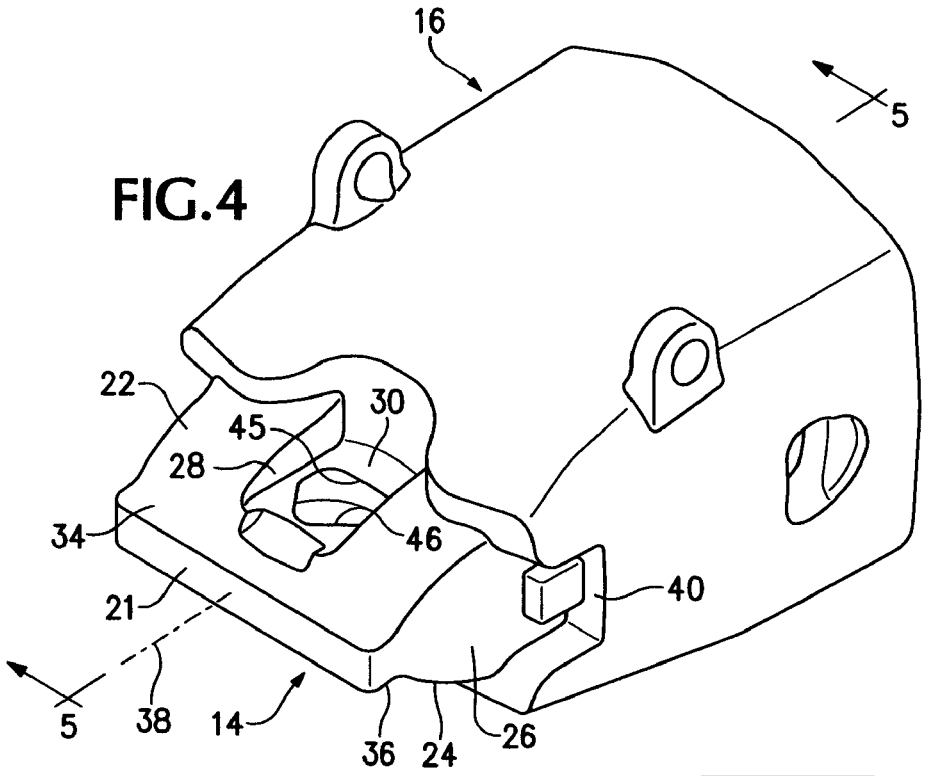
FIG. 4 is a perspective view of the base.
Figure 5:
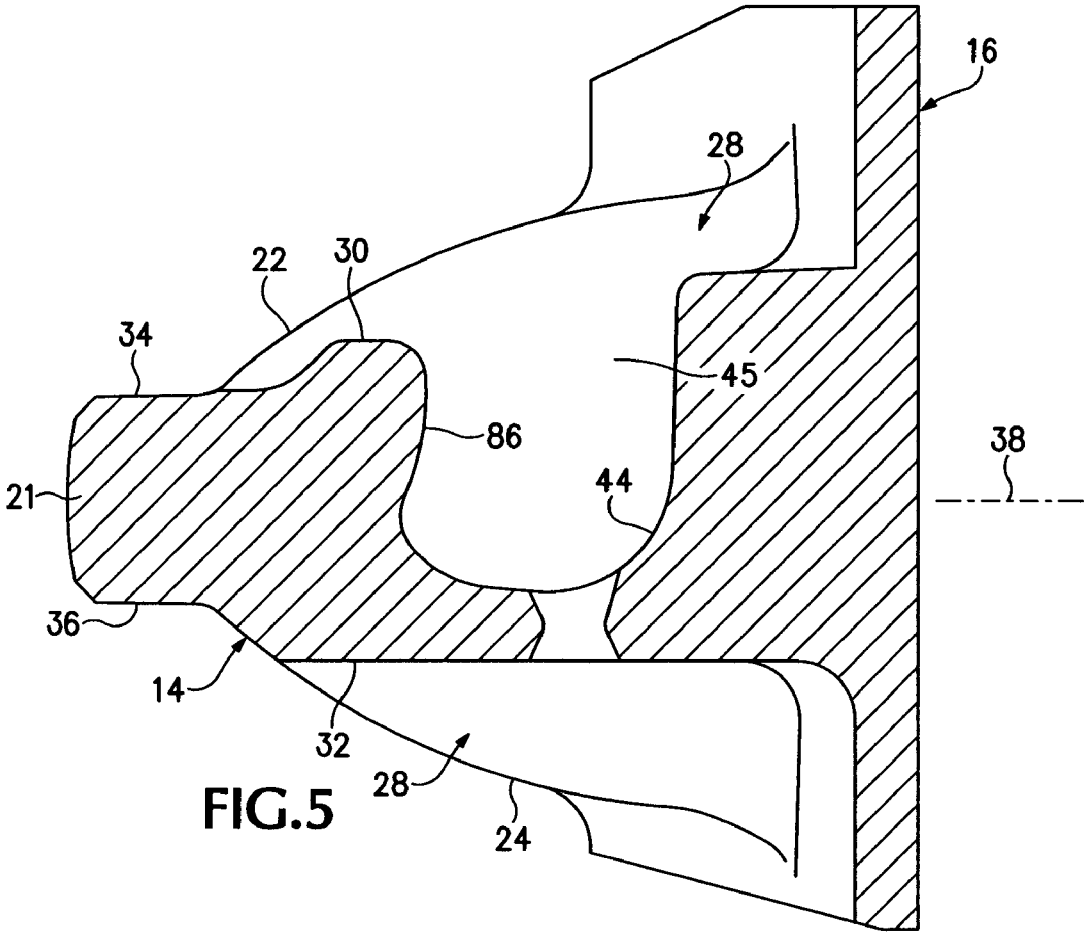
FIG. 5 is a cross sectional view along line 5-5 in FIG. 4.
Figure 6:
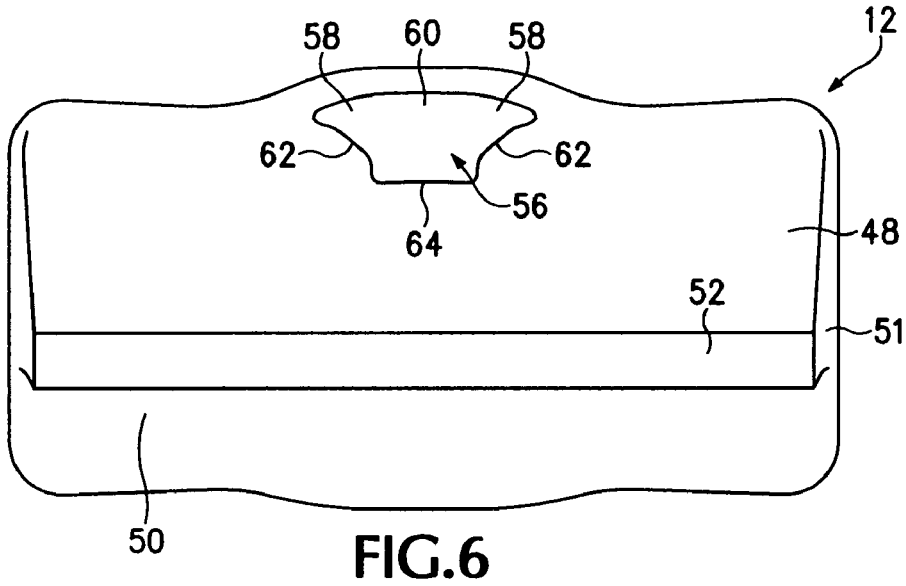
FIG. 6 is a front view of the wear member.

Arm 68 extends forward from an upper portion 86 of body 66 so that pivot member 72 sets against fulcrum 88 defined in front end wall 64 of opening 56 (FIGS. 2 and 3). Fulcrum 88 is forward of and generally aligned with bearing surfaces 58 along longitudinal axis 38. As seen in FIGS. 2 and 3, fulcrum 88 preferably has a lip 90 that overlies pivot member 72 to prevent disengagement during use; although other retention structures could be used. Arm 68 also preferably includes a base surface 92 that presses against upper stabilizing surface 34 under certain loading (e.g., vertical or pull-off loads on the point) for enhanced support and stability. Alternatively, pivot member 72 could be received in a recess formed wholly by wear member 12. Arm 68 could also extend laterally or rearwardly relative to body 66 to change the swinging direction of the lock.

Figure 15:
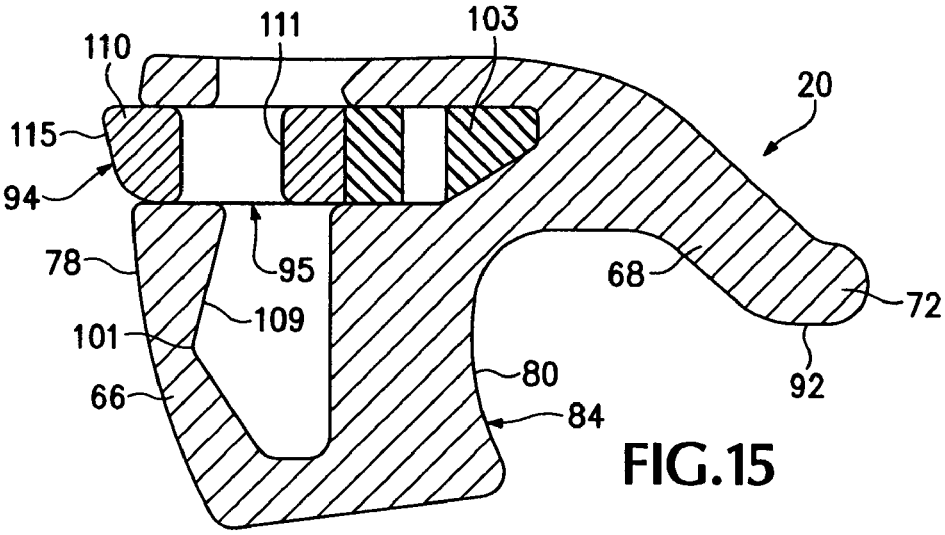
FIG. 15 is a cross-sectional view along line 15-15 in FIG. 14.

As seen in FIGS. 2, 3 and 15, front surface 86 of cavity 44 is preferably convex and curved in a vertical direction to form an undercut gripping surface for lock 20. Front surface 84 of lock 20 is preferably concave and curved to complement surface 86 and fit into the undercut formed by front surface 86. Nevertheless, front surface could have other configurations to engage the convex front surface 86 and provide the desired gripping to help retain lock 20. The curved front surface 84 includes angled bearing faces 76 and front edge 80. Likewise, front surface 86 includes angled bearing surfaces 46 and front portion 82. This curved, fitting relationship is formed relative to the pivot axis of lock 20 so that under vertical or reverse loading on wear member 12 during use lock 20 is pulled into the undercut defined by front surface 86 to grip nose 14 and resist ejection of the lock from the assembly.

Lock 20 includes a latch 94 that fits in slot 95 in body 66 and projects from rear face 78 to cooperate with keeper 98, which in this embodiment is a ledge formed by a channel 99 in rear end wall 60 of opening 56 (FIGS. 2-3 and 10-15). A ridge 100 preferably fits within channel 99 to limit build up of fines against the latch and under certain conditions to provide additional side support. Latch 94 could alternatively project from other surfaces of lock 20 and cooperate with other kinds of keepers. Moreover, the latch 94 could be placed in wear member 12 with the keeper in lock 20. Other kinds of retaining elements could also be used to hold lock 20 in assembly 10. It is also possible to eliminate arm 68 and rely only upon body 66 so long as a retaining element is provided to adequately secure body 66 in the assembly. Also, as an alternative, translating latch 94 may be replaced with other kinds of latches such as a rotating latch as disclosed in U.S. Pat. No. 7,178,274, herein incorporated by reference.

Figures 16, 17:
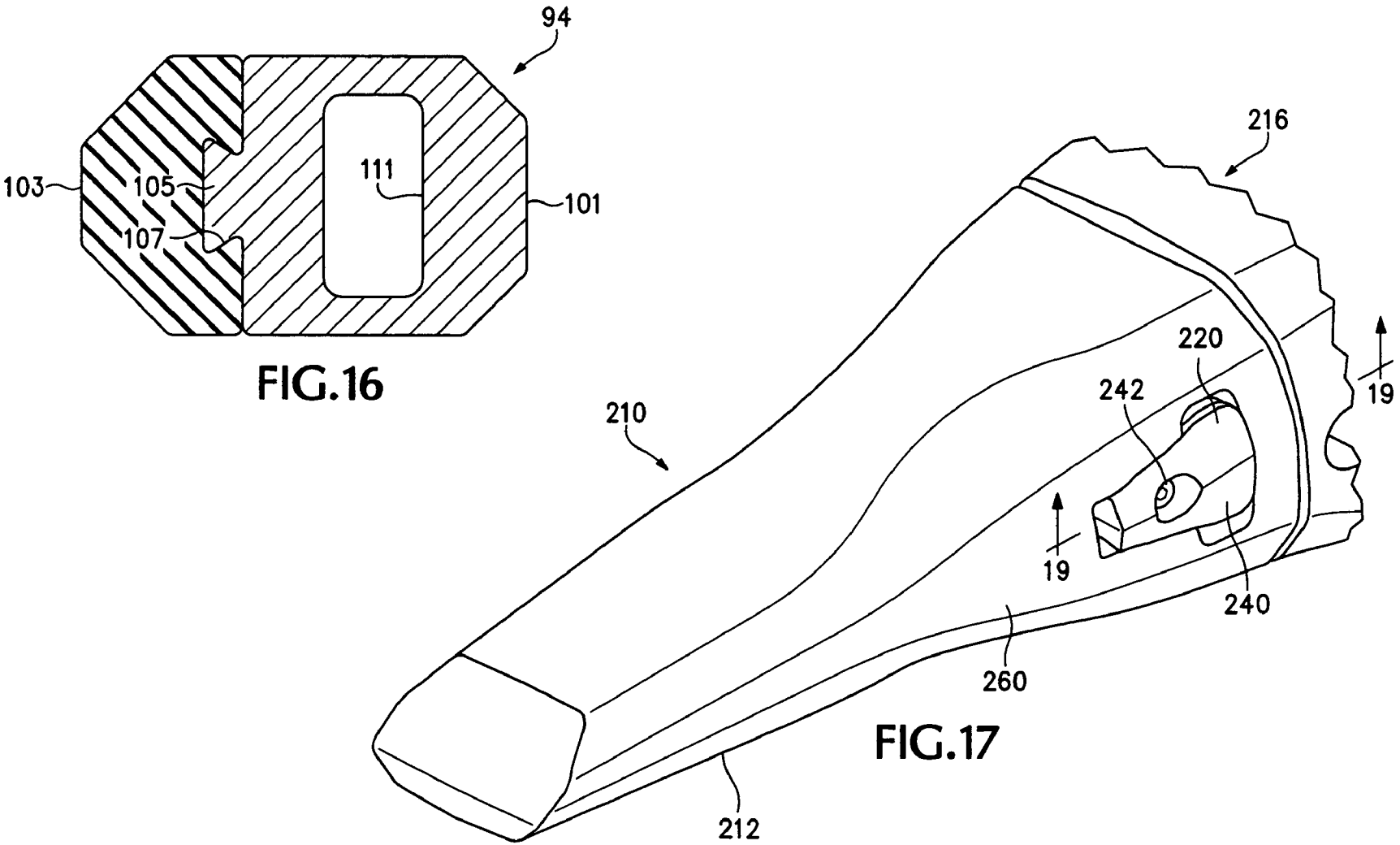
FIG. 16 is a top view of an alternative latch construction for the lock.
FIG. 17 is a partial perspective view of a second wear assembly in accordance with the present invention, i.e., with the mounting portion of the base omitted.

In any event, latch 94 preferably includes a tongue 101 of steel or other rigid material and a resilient element 103 (FIGS. 2, 3 and 15, 16). Tongue 101 is preferably tapered on its distal end and becomes wider than channel 99 to ensure latch 94 remains properly seated within slot 95. The resilient element can be formed of foams, polymers or rubbers or even of other kinds of spring elements. Tongue 101 and resilient element 103 can be bonded together (as seen in FIG. 2) and/or by mechanically attachment such as by a tongue and groove arrangement (as seen in FIG. 16). In this example only, tongue 101 includes a triangular projection 105 that fits in a corresponding triangular groove 107 in elastomer 103. Of course, other arrangements are possible. In any event, resilient element 103 normally biases tongue 101 outward and, in use, beneath ledge 98 to retain lock 20 in assembly 10.

Body 66 preferably includes a removal hole 109 (FIGS. 2, 3, 12 and 15) adapted to receive a pry tool (not shown). Latch 94 includes a passage 111 which in the normal position is partially aligned with hole 109. In use, the pry tool is placed into hole 109 and passage 111 via inlet 113. The tool is then manipulated to push latch 94 forward as described in co-pending U.S. patent application Ser. No. 11/789801, entitled Lock Assembly For Securing A Wear Member To Earth-Working Equipment, with internal reference number 358, filed concurrently herewith, which is incorporated herein by reference. Alternatively, the tool is tapered so that its sides expand so as to push latch 94 forward by being inserted farther into removal hole 109. In either case, this forward shifting causes latch 94 to release ledge 98. The pry tool can then be manipulated to pivot lock 20 about fulcrum 88 and out of cavity 44. Removal hole 109 preferably includes a notch 110 to reduce the risk of the pry tool slipping, but could have a wide variety of shapes. Ordinarily, lock 20 will be removed completely from assembly 10. The pry tool can also be used to install lock 20; the lock may also be pushed into opening 56 and cavity 44 with the user's hands. Tongue 101 preferably includes an inclined front face 115 to permit easy insertion. With this lock, then, there is no need to use hammers to remove or install the locks.

Rear surface 78 of body 66 is preferably formed with a convex, curved surface to generally follow the swinging motion of the lock in and out of cavity 44 to minimize the size of opening 56 (FIGS. 2 and 3). The rear wall 60 of opening 56 is concave and curved to accommodate the swinging motion of lock 20 and to depress latch 94 to ease installation. In a preferred construction, the curvature of rear wall 60 is broader than the curvature of rear surface 78 and is defined by a radius of curvature having a different origination point (i.e., offset from the pivot axis of lock 20) so that rear surface 78 pulls away from rear wall 60 as lock 20 is swung out of assembly 10, as described in co-pending U.S. patent application Ser. No. 11/789801, entitled Lock Assembly For Securing A Wear Member To Earth-Working Equipment, with internal reference number 358, and filed currently herewith. In this way, impacted fines pose less resistance to removal of the lock.

Figure 7:
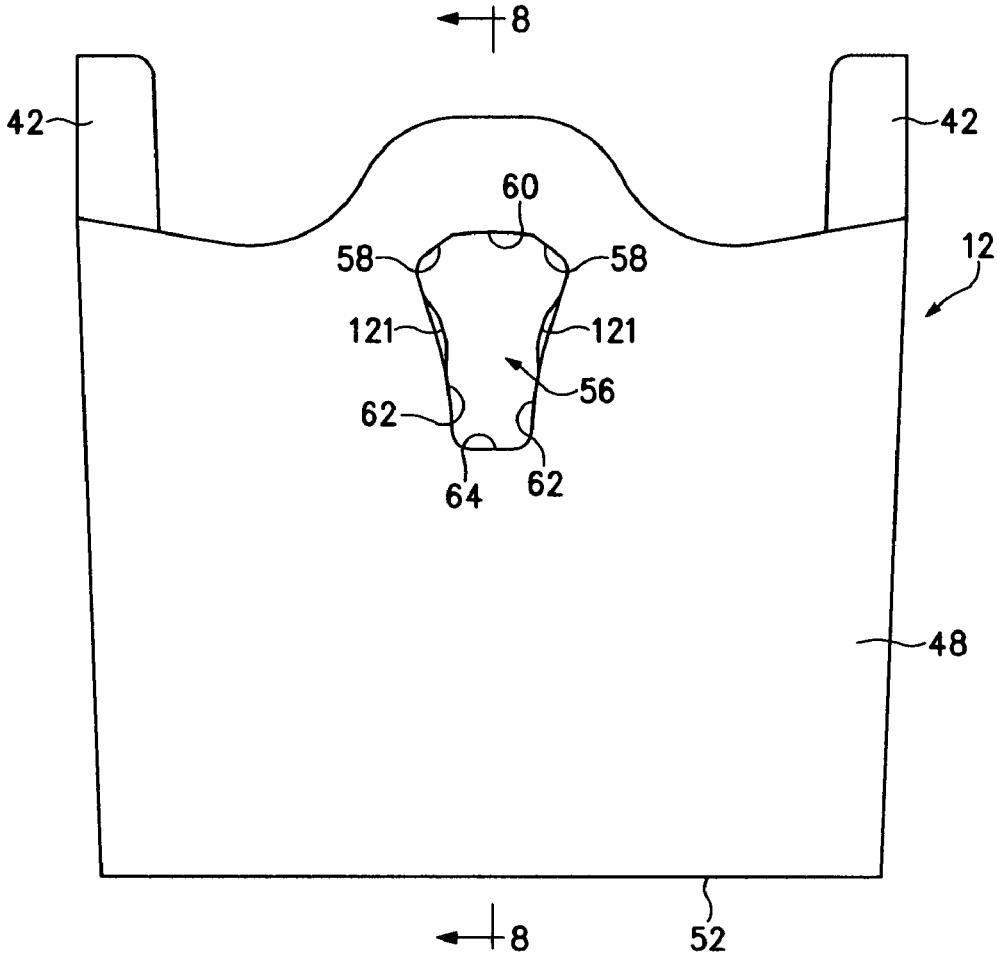
FIG. 7 is a top view of the wear member.
Figure 8:
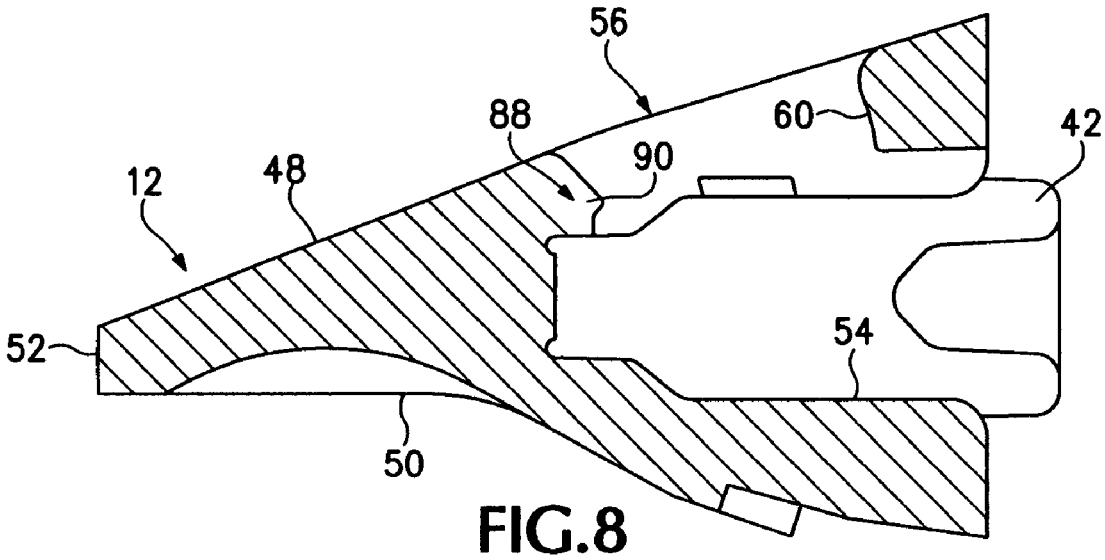
FIG. 8 is a cross-sectional view along line 8-8 in FIG. 7.
Figure 9:
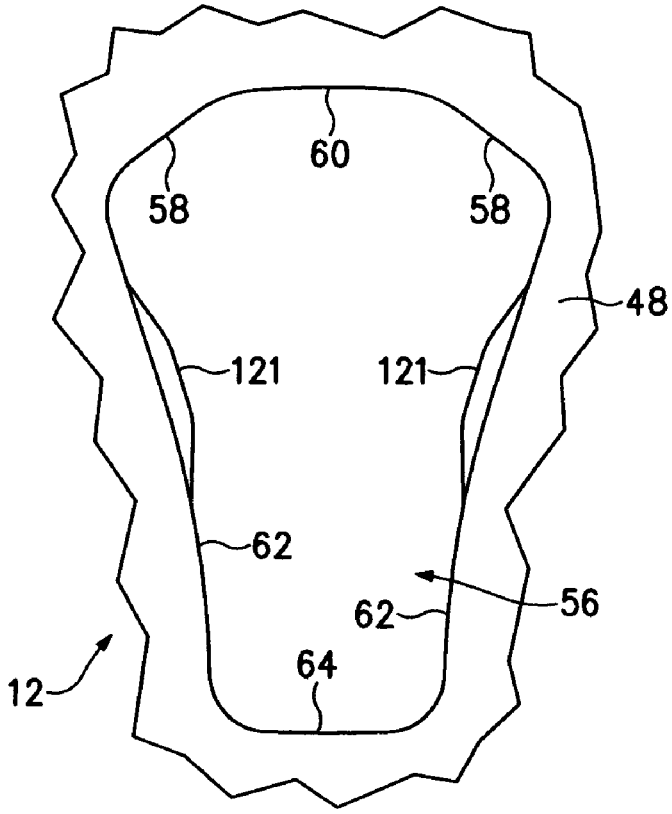
FIG. 9 is a partial top view of the wear member showing the lock-receiving opening.
Figure 10:
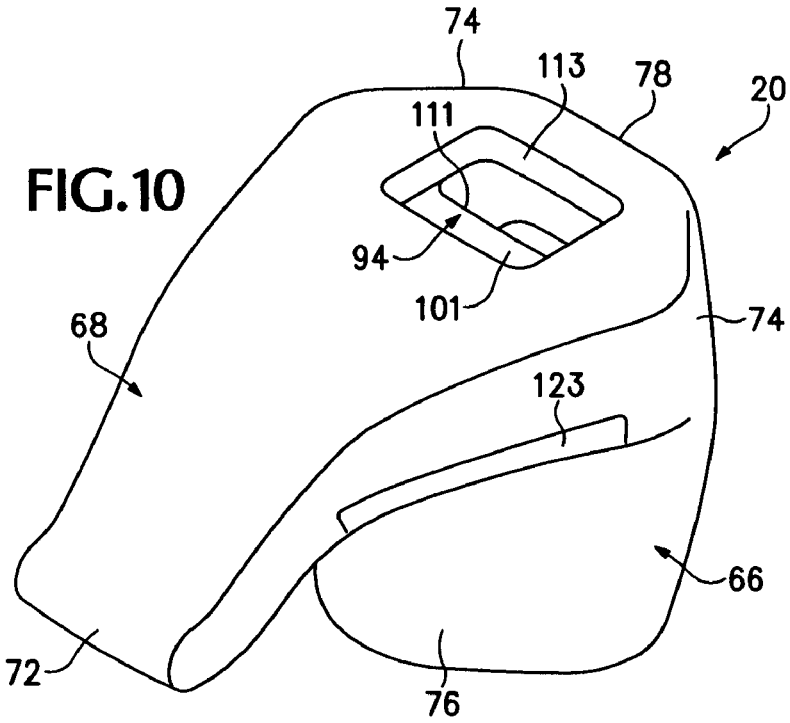
FIG. 10 is a perspective view of the lock.
Figure 11:
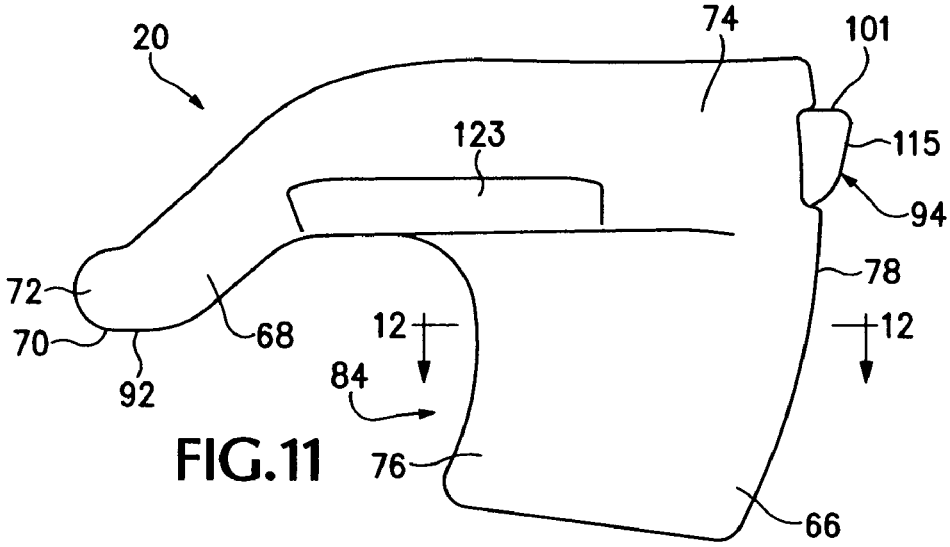
FIG. 11 is side view of the lock.
Figure 12:
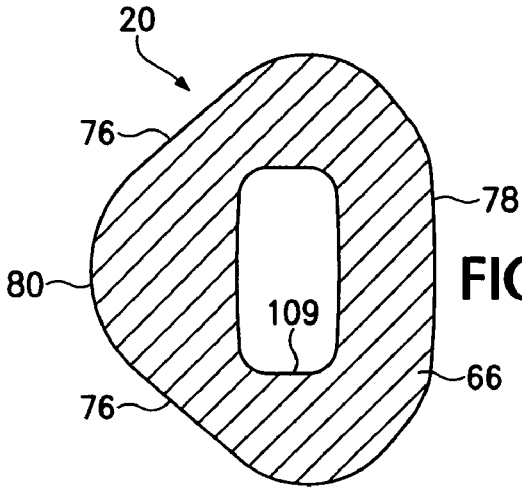
FIG. 12 is cross-sectional view along line 12-12 in FIG. 11.
Figure 13:
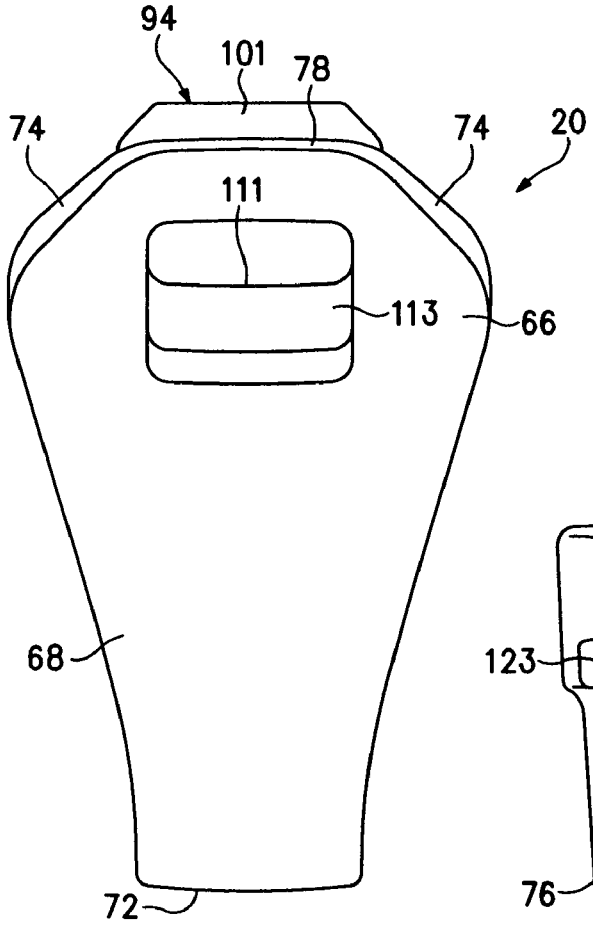
FIG. 13 is top view of the lock.

Opening 56 preferably includes a shoulder 121 along each side 62 to support lock 20 in the hold position (FIGS. 7-9). In a preferred arrangement, body 66 includes a groove 123 to receive each shoulder 121. Shoulders 121 prevent lock 20 from falling too far into cavity 44 and becoming wedged into opening 56, thus, making removal difficult. Shoulders 121 could be longer or shorter than shown or arranged in different portions of opening 56.

If the shoulders are lengthened, they could be used to support lock 20 in opening 56 without nose 14 in socket 18. In this arrangement, lock 20 can be secured to wear member 12 to form a single, integral component. The lock and wear member can, then, be shipped as a single unit and stored by a dealer or end user without fear of losing the lock. Since fewer parts are required to be shipped and stored, shipping costs and inventory concerns are reduced. Other arrangements could also be used to secure lock 20 integrally to wear member 12. For example, a different fulcrum could be used to more securely hold the pivot member of the lock from moving vertically in either direction. Also, other kinds of retaining members in addition to or in lieu of shoulders 121 could be used.

In an alternative embodiment, the wear member or point 212 is adapted to fit on a nose 214 (FIGS. 17-21). The nose is the front portion of a base 216 (FIGS. 21 and 22) that is fixed to a bucket (not shown) or other equipment. In the illustrated example, base 216 includes rearward legs 219, 221 that extend over and are welded to the lip of the bucket. Wear member 212 is releasably secured to nose 214 by a lock 220.

Figure 21:
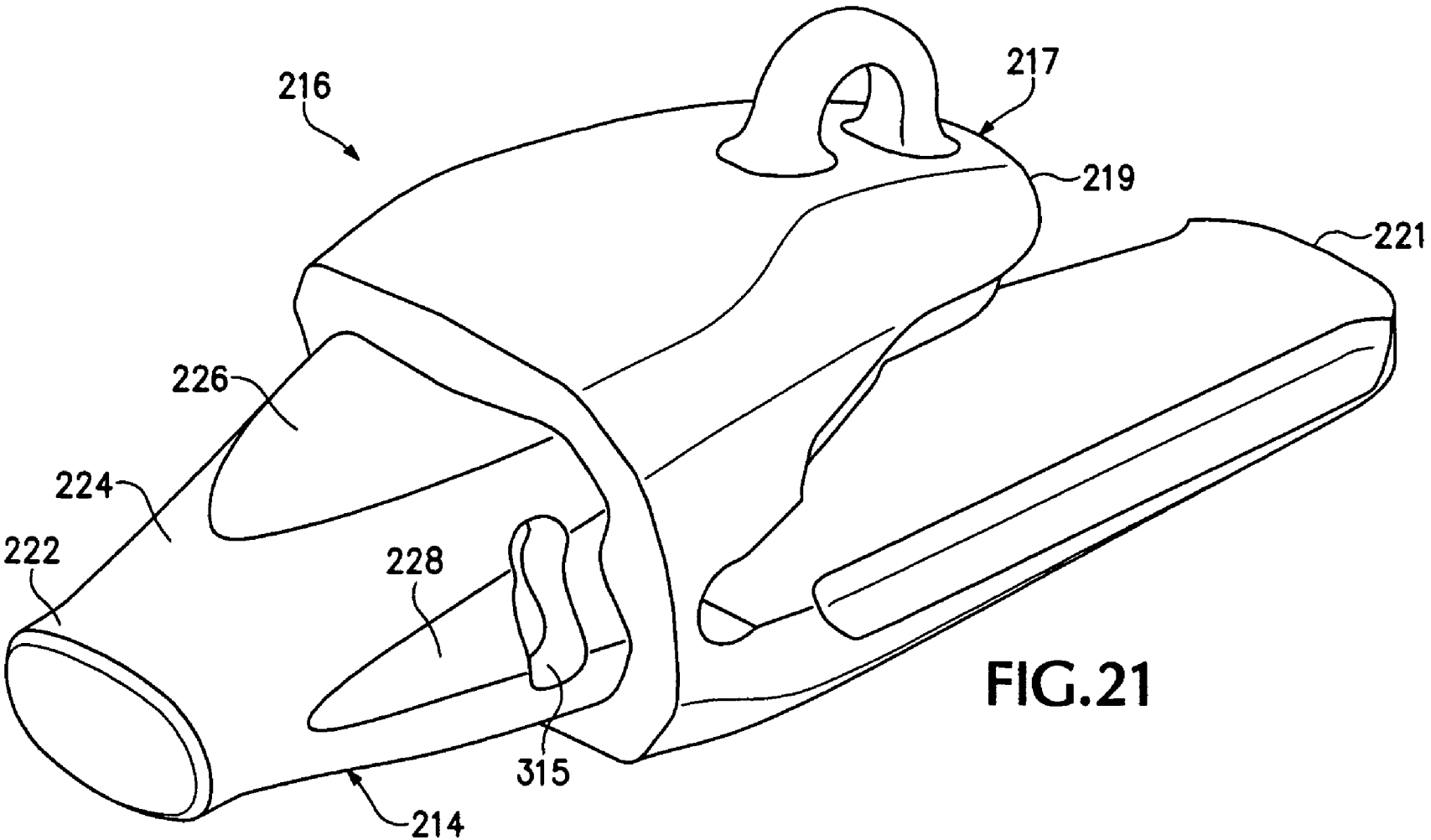
FIG. 21 is a perspective view of a base for the wear assembly.
Figure 22:
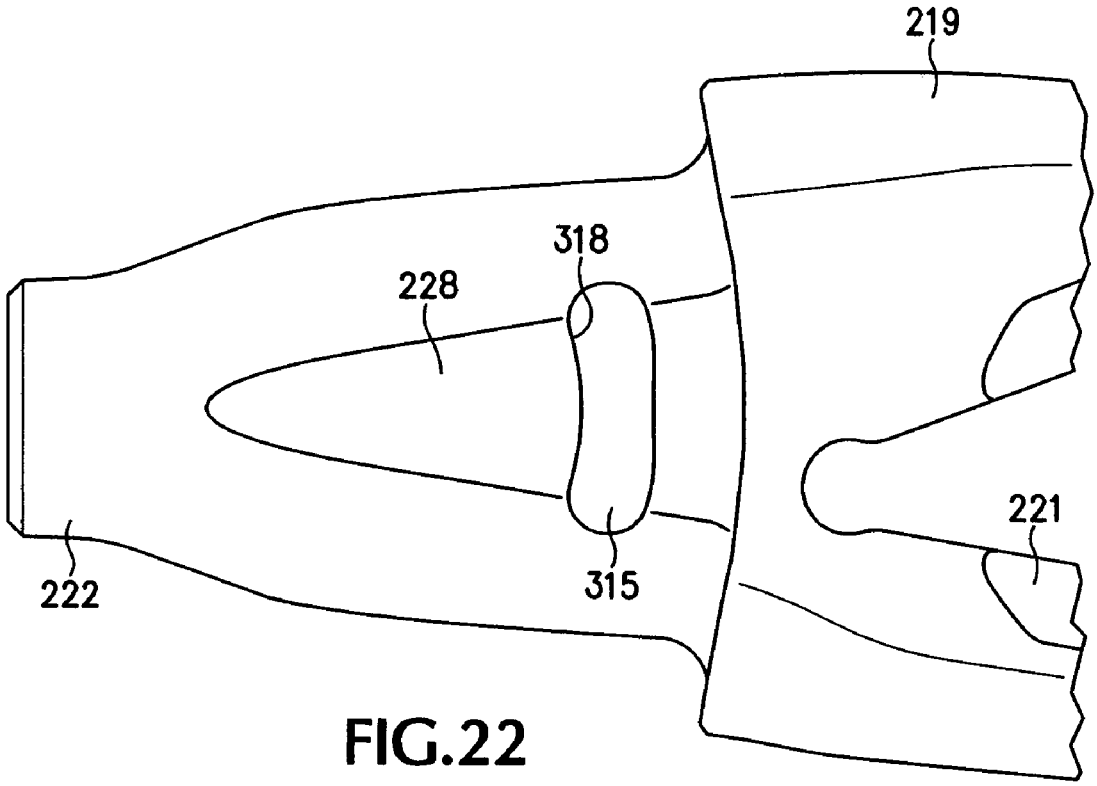
FIG. 22 is a side view of the base.
Figure 23:
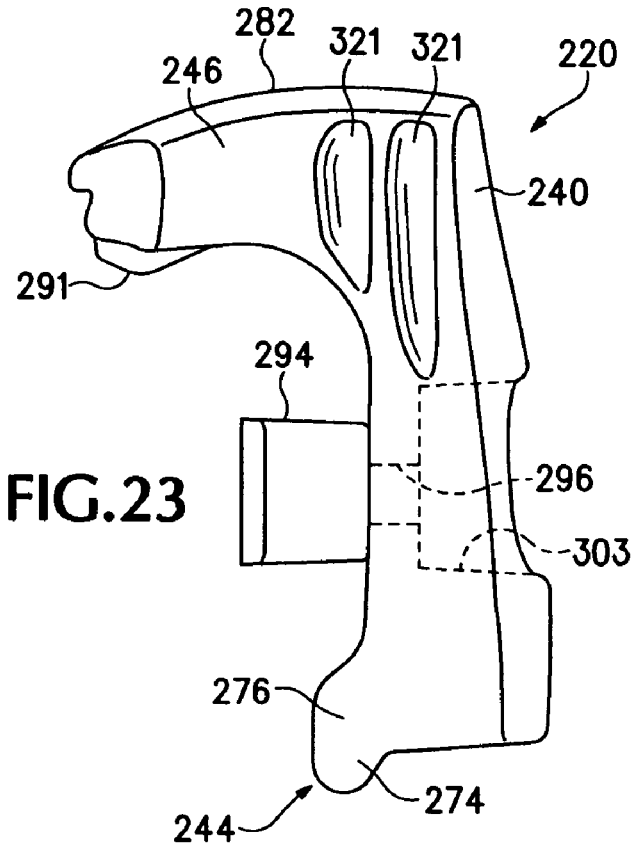
FIG. 23 is a top view of the lock.
Figure 24:
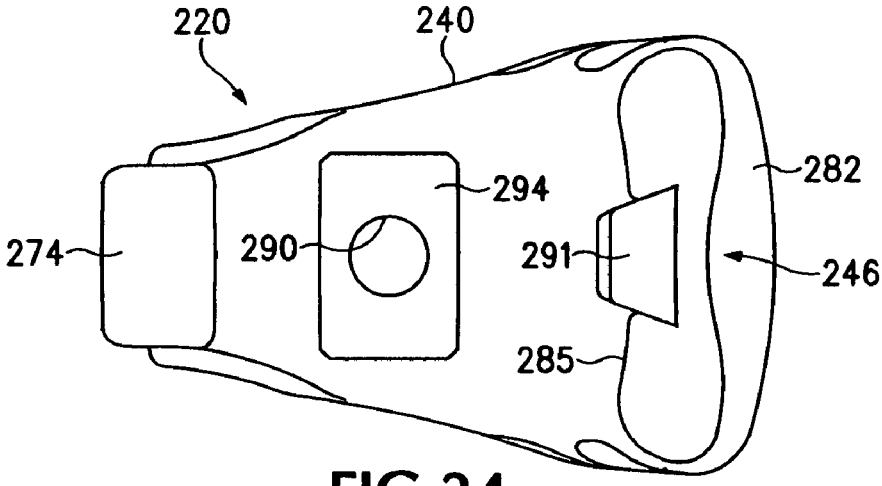
FIG. 24 is an inner side view of the lock.
Figure 25:
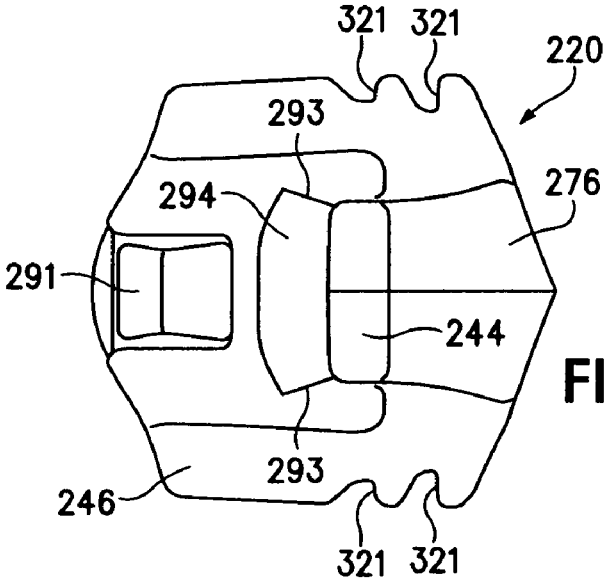
FIG. 25 is a front view of the lock.
Figure 26:
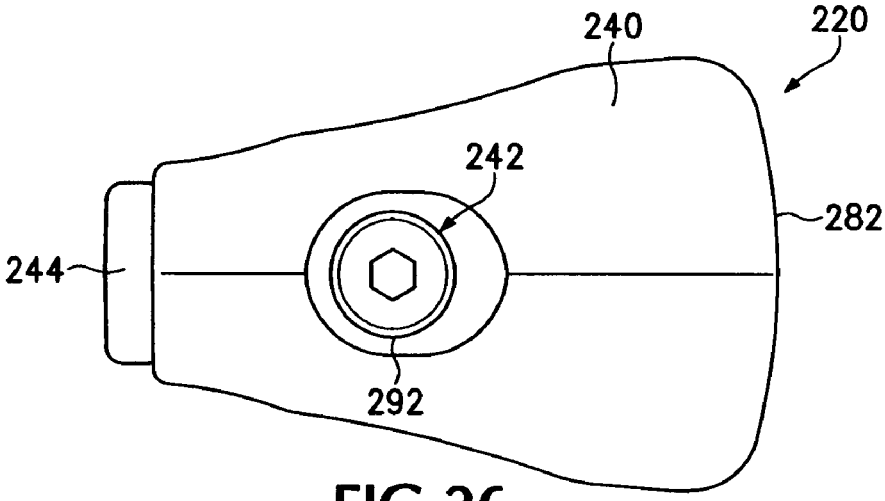
FIG. 26 is an outer side view of the lock.
Figure 28:
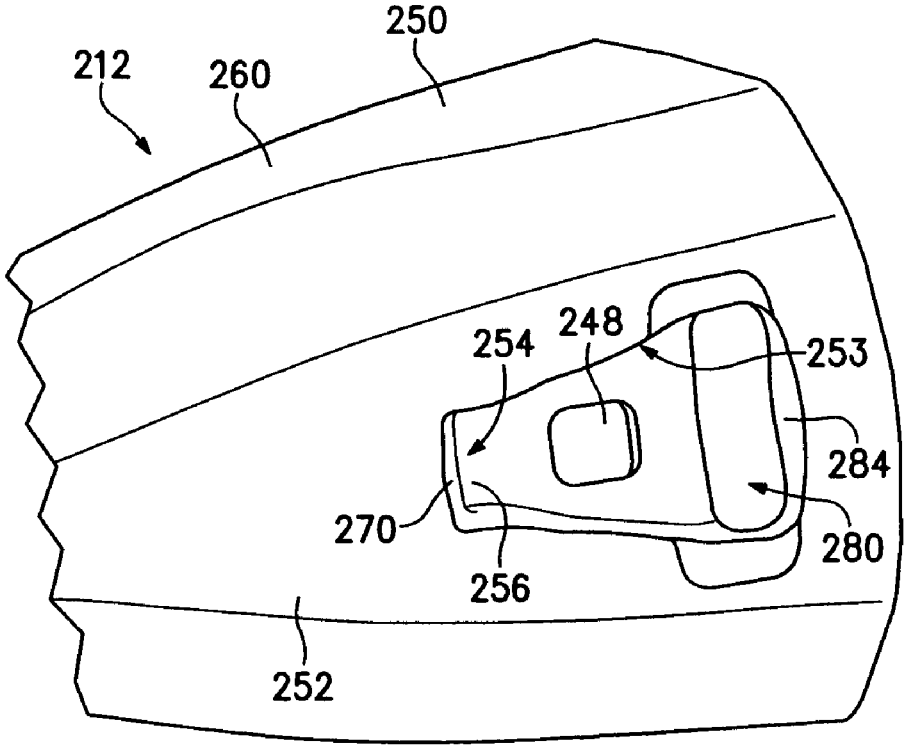
FIG. 28 is a partial perspective view of the wear member.
Figure 29:
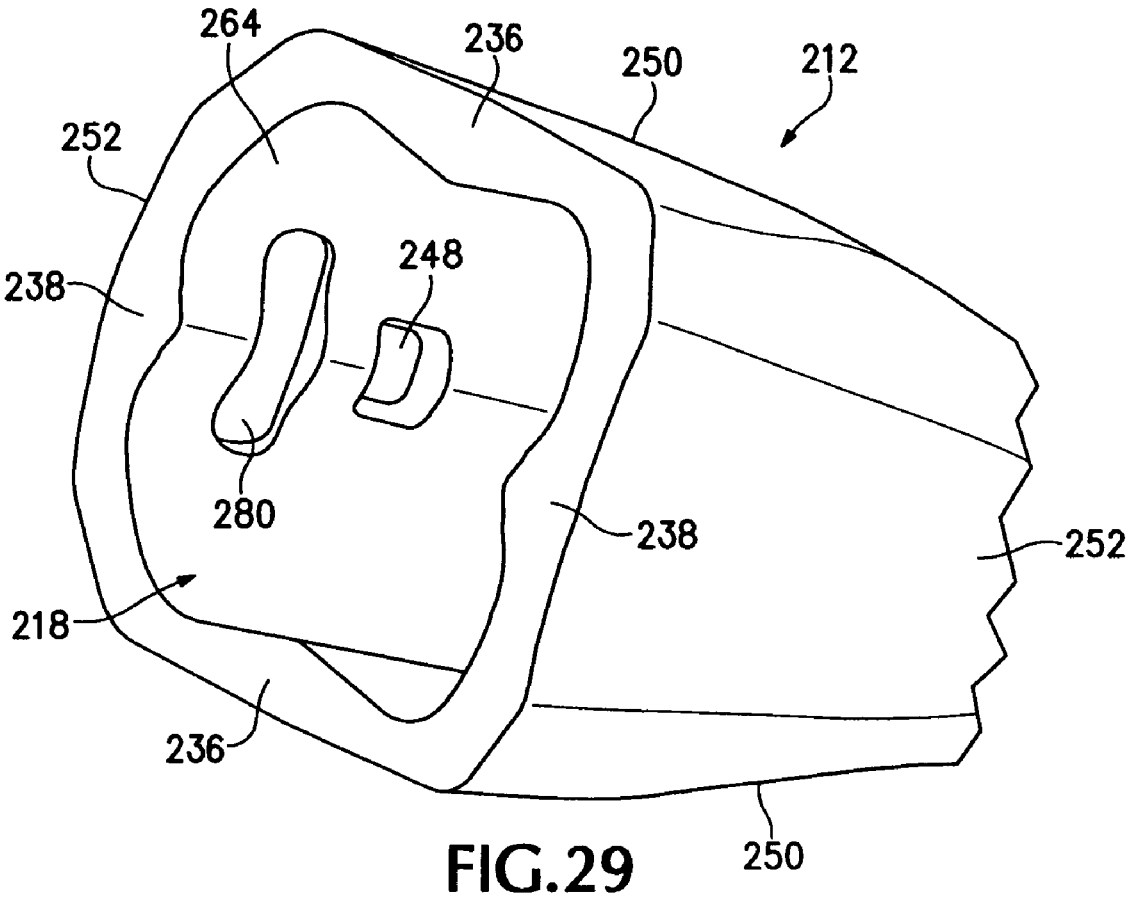
FIG. 29 is a partial, rear perspective view of the wear member.

As one example, the nose and socket are generally as described in co-pending U.S. patent application Ser. No. 11/706,592 filed Feb. 14, 2007, which is hereby incorporated by reference; i.e., the nose and socket constructions are the same except for the formations associated with the locking arrangement. In general, nose 214 includes a front stabilizing end 222 and a body 224 having stabilizing recesses 226, 228 (FIGS. 21 and 22). Wear member 212 includes a socket 218 adapted to matingly receive nose 214 (FIGS. 28 and 29). Accordingly, socket 218 has a complementary front stabilizing end 232 and a main portion 234 provided with stabilizing projections 236, 238 to fit in recesses 226, 228. Nevertheless, other nose and socket formations could be used with the locking concepts of the present invention.

Lock 220 includes a body 240 and a threaded member 242 (FIGS. 23-27). In one preferred construction, body 240 includes a pivot member 244 at one end, a retention member 246 at the opposite end, and a central hole 248 for receiving and cooperating with the threaded member 242. In general, lock 220 swings about pivot member 244 between a hold position that retains wear member 212 to nose 214, and a release position which permits installation and removal of the wear member to and from the nose.

Figure 20:
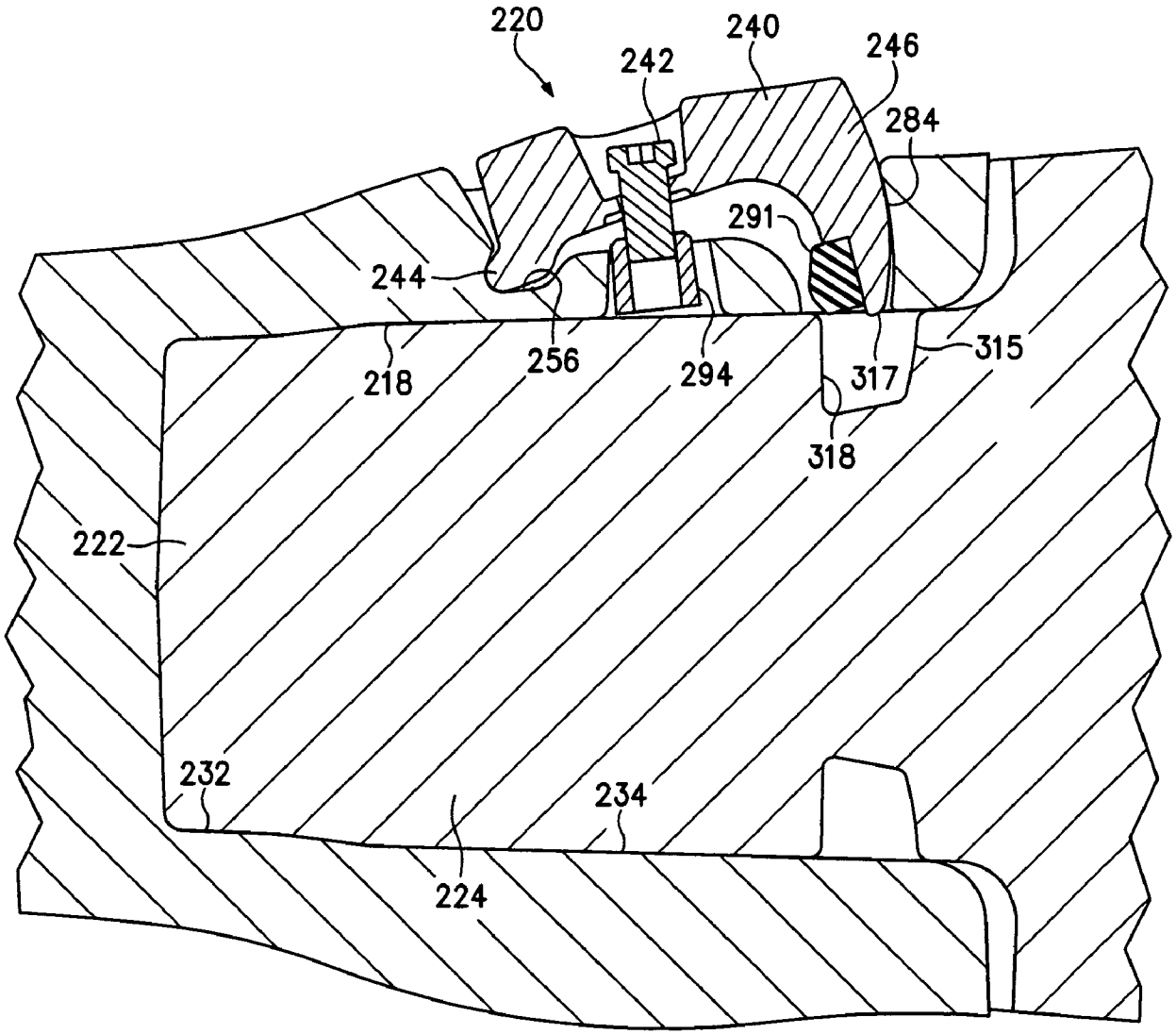
FIG. 20 is a cross-sectional view taken along lines 20-20 in FIG. 18.

Wear member 212 includes converging walls 250 and sidewalls 252 (FIGS. 17-18 and 28-29). In a preferred construction, at least one of the sidewalls includes an opening 253 for receiving lock 220. An opening could be included in both sidewalls to enable reversing of the wear member on the nose and/or to permit the use of two locks; however, only a single lock on one side is needed to secure the wear member to the nose. Alternatively, reversible mounting could be achieved by providing two openings in the nose (as shown in FIG. 20). Mounting the lock in a sidewall enables a secure attachment for the wear member in a location that is more protected from wear in most applications. The illustrated construction of lock 220 is particularly suited for side mounting so as to enhance stability and reduce wear for loads and shifting anticipated during a digging operation. Nevertheless, opening 253 could, in the same way, be formed in one or both of the converging walls 250 instead of sidewalls 252.

Figure 19:
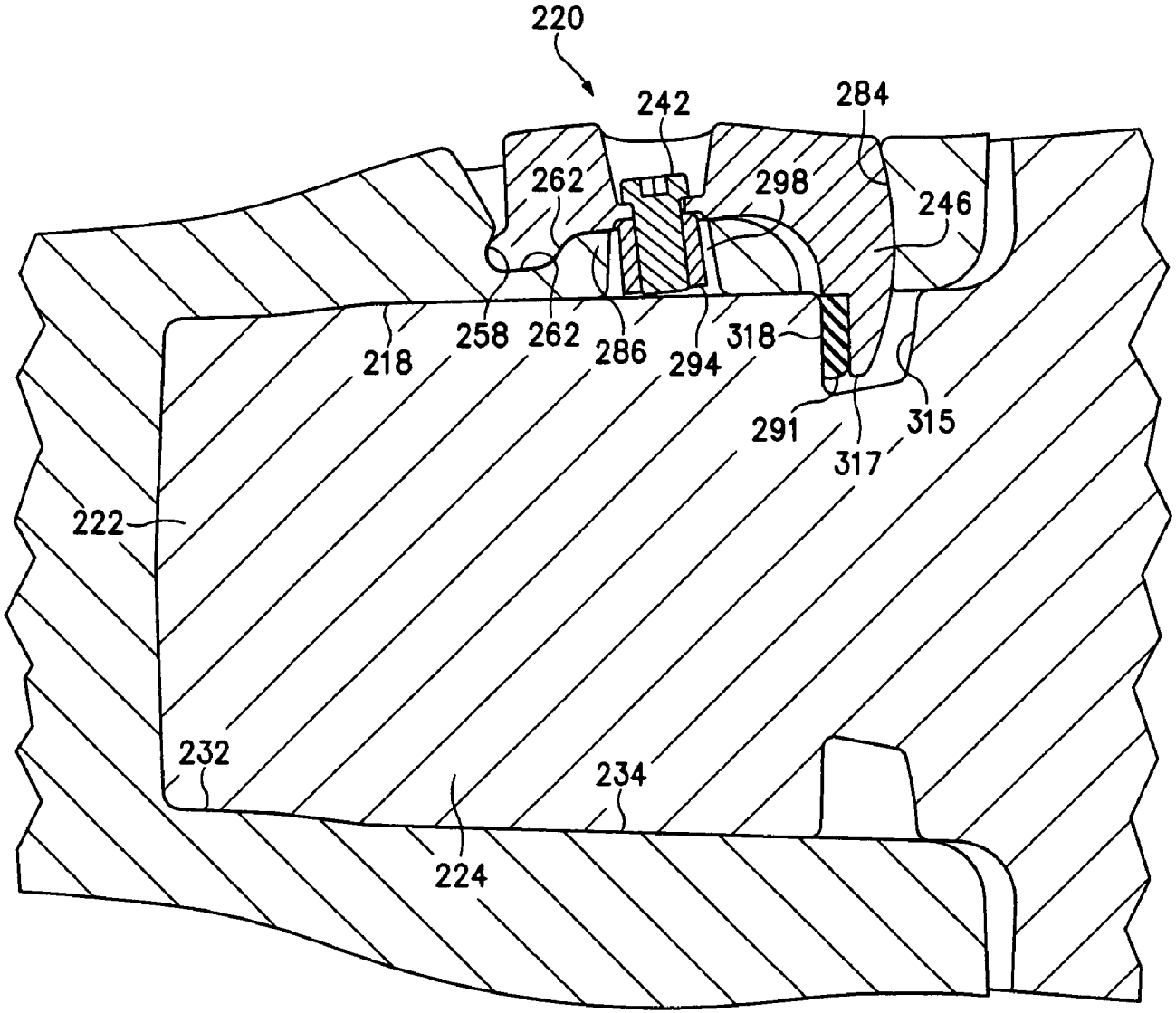
FIG. 19 is a cross-sectional view taken along lines 19-19 in FIG. 17.

Opening 253 includes a pivot support 254, preferably at a front end of the opening, to cooperate with pivot member 244 of lock 220 (FIGS. 28 and 29). Pivot support 254 is preferably in the form of a recess 256 open to exterior surface 260. Pivot member 244 is defined by a lug 274 that extends forward from a front end 276 of body 240 (FIGS. 23-27). Lug 274 sets in recess 256 to facilitate rotation of 220 (FIGS. 19 and 20). Threaded member 242 retains the lock to the wear member. To maximize strength in the wear member, opening 253 narrows toward front wall 270. Of course, other pivoting constructions could be used.

Opening 253 further includes a through-hole 280 at its rear end for passage of the retention member 246 through sidewall 252 to engage nose 214 (FIGS. 28 and 29). In the illustrated embodiment, retention member 246 has a wide abutment surface 282 to oppose the rear wall 284 of opening 253 (FIGS. 23-27). In addition, in the preferred nose and socket design, the cooperating recess 228 and projection 238 provide rear wall 284 with an increased depth (i.e., inward toward nose 214) for additional surface area to engage abutment surface 282. Since the engagement of abutment surface 282 and rear wall 284 resists removal of wear member 212 from nose 214, a larger surface area reduces stress in the components and increases the life of the locking arrangement. Abutment surface 282 and rear wall 284 are each preferably curved to complement each other. Rear wall 284 is a concave surface that is preferably defined by a radius of curvature originating at a location directly forward of rear wall 284 that generally corresponds to about the middle one-third portion of socket 20 that receives nose 214. This broad curvature generally conforms to the anticipated shifting of the wear member 212 on nose 214 to reduce wearing and improve stability. Likewise, front surface 285 of lock 220 is concave and curved such that its radius of curvature has the same origination point as the radius of curvature for rear wall 284. Front surface 285 abuts complementary convex wall 318 on nose 214.

Figure 27:
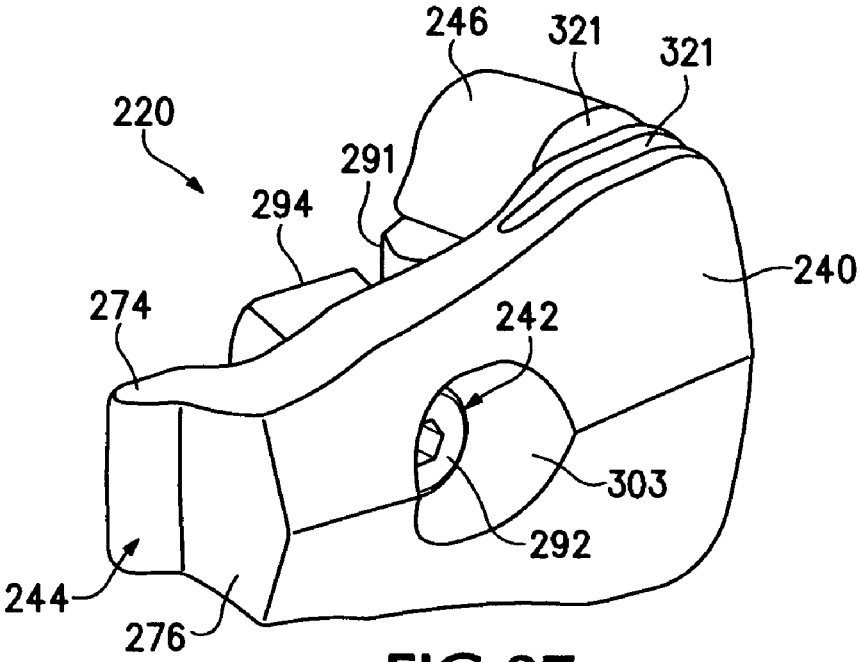
FIG. 27 is a perspective view of the lock.

A medial wall 286 is provided in opening 253 between recess 256 and through-hole 280 to cooperate with threaded member 242 (FIGS. 19, 27 and 28). Medial wall 286 is preferably depressed relative to outer wear surface 260 to enable lock 220 to be fit within opening 253 to eliminate obstructions to the flow of material around the wear member and to partially protect the lock from wear during use. In a preferred construction for this embodiment, threaded member 242 is a bolt with a threaded shank 290 and head 292, and a nut 294 to engage shank 290 (FIGS. 23-27). Medial wall 286 includes a central hole 248 through which shank 290 extends. A cavity 298 is formed on the interior side of medial wall 286 to receive and prevent nut 294 from rotating. Cavity 298 preferably narrows outward to complement side walls 293 of nut 294 to retain nut 294, though other shapes are possible. In use, lock 220 is tightened down against nut 294 but is loosely held with respect to wear member 212 to reduce stress and wear in the lock. Lock 220 is secured to wear member 212 prior to installation on nose 214. In this way, nut 294 can be held from within socket 218 for engagement with shank 290. Nevertheless, other arrangements could be used. For example, nut 294 could be secured within cavity 298 by an adhesive, welding or other means for later attachment to shank 290. Alternatively, bore 296 could be threaded instead of using nut 294.

Body 240 of lock 220 also includes a hole 248 that generally aligns with hole 248 in medial wall 286. Hole 248 is oversized relative to shank 290 to permit the pivotal motion of body about pivot support 254. A pocket 303 is provided about bore 296 to receive head 292 and permit the attachment of a tool (e.g., a socket wrench) for turning of threaded member 242. The free end 307 of threaded member 242 may be deformed to prevent its release from nut 294.

In use, lock 220 is attached to wear member 212 by inserting pivot member 244 into recess 256. Threaded member 242 is fed through hole 248 and threaded to nut 294 in cavity 298. Retention member 246 is received into through-hole 280. In an extended position of lock 220 (FIGS. 18 and 20), i.e., the release position, retention member 246 sets within through-hole 280 but does not extend into socket 218. As an alternative, lock 220 may be provided with a latch as opposed to a threaded member. For example, lock 220 may have a translating latch as in lock 20 or a rotating latch as in U.S. Pat. No. 7,178,274.

Lock 220, once secured, forms a single, integral component with wear member 212. The lock and wear member can, then, be shipped as a single unit and stored by a dealer or end user without fear of losing the lock. Also, since fewer parts are required to be shipped and stored, shipping costs and inventory concerns are reduced. Additionally, since lock 220 remains secured to wear member 212 in the release and hold positions, the wear member can be installed with the lock to reduce the number of components needed for assembly and virtually eliminate the problems associated with dropped and/or lost locks in the field.

Once the wear member 212 has been fit onto nose 214, threaded member 242 can be rotated to drive lock body 240 in an arc about pivot support 254 and move retention member 246 into socket 218 to engage nose 214 (FIGS. 17 and 19). Nose 214 includes a groove 315 to receive the free end 317 of retention member 246 (FIGS. 19-22). The retention member is then positioned between rear wall 284 of wear member 212 and front face 318 of groove 315 (FIG. 19). As a result, the loads are carried by retention member 246, which is formed as a rigid block (preferably of steel) to accommodate heavy loading. In this way, the loads are not transmitted forward to threaded member 246. As a result, there is no deformation of shank 290 during use to impede the movement of the lock to the release position. An elastomer 291 or other spring means (not shown) can be provided on retention member 246 to press against wall 318 to provide take up for wear member 212.

Groove 315 is preferably a narrow channel in a side 320 of nose 314 (FIGS. 21 and 22). The top and bottom ends of groove 315 are preferably closed to retain, as much as possible, the strength and continuity of nose 214 despite the engagement with lock 220. Nevertheless, groove 315 could have other constructions. For example, groove 315 may extend across the entire side 320 and be open at its top and bottom. Also, groove 315 may be open rearwardly so that groove is essentially a shoulder with a rearwardly facing abutting surface 318.

Figure 18:
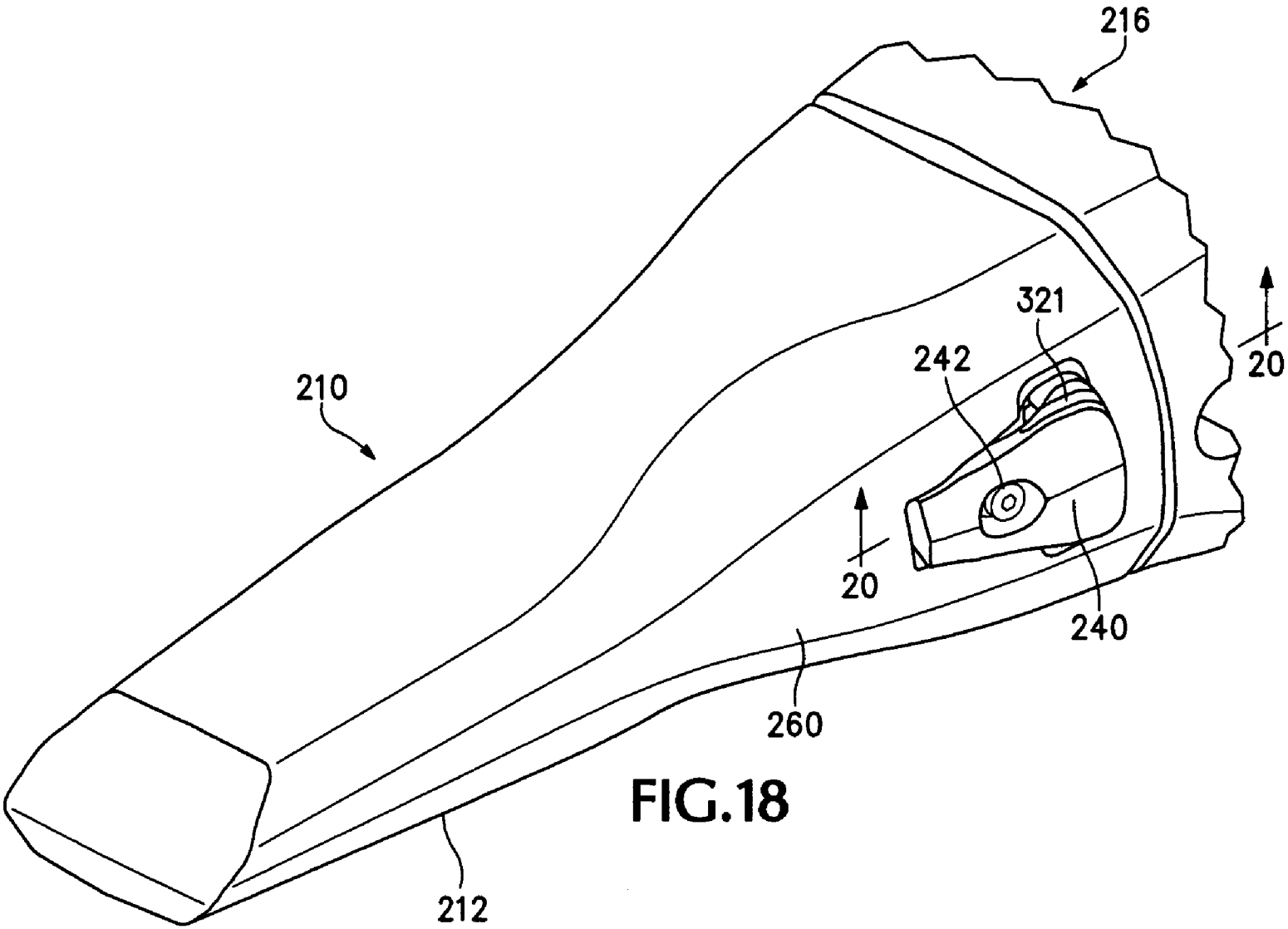
FIG. 18 is a partial perspective view of the second wear assembly similar to FIG. 17 except that the lock is moved to its release position.

When wear member 212 needs to be replaced, threaded member 242 is loosened so that head 292 backs outward away from nose 214 (FIGS. 18 and 20). Once loosened, the lock can be rotated to its release position with just the operator's hands or via a pry tool. Pry slots 321 in body 240 are provided to facilitate the use of a pry tool in rotating lock 220 from the hold position to the release position (FIGS. 17-20 and 26). An elastomer or other spring (not shown) may be provided to push lock 220 outward or to pull the lock inward as threaded member 242 is turned. In addition, a fixed flange (not shown) on shank 290 could be provided between medial wall 286 and body 240 to push lock 220 to its release position when threaded member 242 is loosened.

While preferred constructions and some variations are disclosed for illustration purposes, many other variations in the nose, point and lock constructions could be made without departing from the spirit of the invention.

The invention claimed is:

1. A wear member for excavating equipment comprising:

a front end, a rear end, and a longitudinal axis extending from the front end to the rear end;

converging walls that converge toward the front end, side walls extending between the converging walls, and a socket that opens in the rear end to receive a base fixed to the excavating equipment;

a hole extending through one of the walls for receiving a lock to releasably hold the wear member to the base, the hole including a pair of bearing surfaces for engaging the lock when in the hole to prevent release of the wear member from the base, one of the bearing surfaces being on each side of the longitudinal axis, and said bearing surfaces being inclined to each other so as to diverge in a forward direction; and a fulcrum for engaging the lock for pivotal movement between a hold position when the lock prevents release of the wear member from the base and a release position when the wear member can be released from the base, the fulcrum and the bearing surfaces being generally positioned along the longitudinal axis with the fulcrum positioned in front of the bearing surfaces.

2. A wear member in accordance with claim 1 wherein the hole narrows in a forward direction between the bearing surfaces and the fulcrum.

3. A wear member in accordance with claim 2 wherein the bearing surfaces are concave and curved in the direction the hole extends through the wall.

4. A wear member in accordance with claim 3 wherein the bearing surfaces are generally linear in a lateral direction.

5. A wear member in accordance with claim 4 wherein the hole is formed in one of the converging walls.

6. A wear member in accordance with claim 5 wherein the hole further includes a stop between the bearing surfaces for cooperating with a latch on the lock to releasably hold the lock in the hole.

7. A wear member in accordance with claim 6 wherein the hole includes at least one ledge to contact the lock when inserted into the hole to prevent over-insertion of the lock into the hole.

8. A wear member for excavating equipment comprising:

a front end, a rear end, and a longitudinal axis extending from the front end to the rear end;

converging walls that converge toward the front end, side walls extending between the converging walls, and a socket that opens in the rear end to receive a base fixed to the excavating equipment;

a hole extending through one of the walls for receiving a lock to releasably hold the wear member to the base, the hole including at least one bearing surface for engaging the lock when in the hole to prevent release of the wear member from the base, wherein the bearing surface has a curved, concave surface in a direction perpendicular to the direction the hole extends through the wall; and a fulcrum for engaging the lock for pivotal movement between a hold position when the lock prevents release of the wear member from the base and a release position when the wear member can be released from the base, the fulcrum and the bearing surface being generally positioned along the longitudinal axis with the fulcrum positioned in front of the bearing surface.

9. A wear member in accordance with claim 1 wherein the hole extends through one of the converging walls.

10. A wear member in accordance with claim 8 wherein an anchor for a threaded member is formed between the fulcrum and the bearing surface.

11. A wear member in accordance with claim 8 wherein the curved bearing surface is defined by a radius of curvature that originates at a forward location which generally corresponds to a middle one-third of the socket that receives the nose.

12. A wear member in accordance with claim 11 wherein the fulcrum is defined by a recess spaced from the hole.

13. A wear member in accordance with claim 8 wherein the hole is defined in one of the side walls.

14. A wear member in accordance with claim 1 wherein the hole extends through one of the side walls.

15. A wear member for excavating equipment, the wear member comprising converging walls that converge toward a front end, side walls extending between the converging walls, a socket that opens in a rear end to receive a base fixed to the excavating equipment, and a hole extending through one of the walls for receiving a lock to releasably hold the wear member to the base, the hole communicating with the socket and having a rear portion that includes a pair of forwardly-facing bearing surfaces to abut the lock and hold the wear member to the base, wherein the bearing surfaces are inclined to diverge from each other in a forward direction.

16. A wear member in accordance with claim 15 wherein the hole forward of the bearing surfaces tapers toward a narrow front edge of the hole.

17. A wear member in accordance with claim 16 wherein the forward edge of the hole defines a fulcrum about which the lock pivots between hold and release positions.

18. A wear member in accordance with claim 17 wherein the hole includes a stop for engaging a latch on the lock and retaining the lock in the hole.

19. A wear member in accordance with claim 15 wherein the hole is defined in one of the converging walls.

20. A wear member for excavating equipment comprising converging walls that converge toward a front end, side walls extending between the converging walls, and a socket that opens in a rear end to receive a base fixed to the excavating equipment, wherein one of the walls includes a hole extending through one of the side walls for receiving a lock to releasably secure the wear member to the base, the hole having a rear bearing surface, the rear bearing surface being concave and curved, wherein the curved bearing surface is defined by a radius of curvature that originates at a forward location which generally corresponds to a middle one-third of the socket that receives the nose.

21. A wear assembly for excavating equipment comprising:

a base fixed to the excavating equipment and including a forwardly projecting nose, the nose having a cavity with a curved, convex front surface that forms an undercut portion;

a wear member having a socket for receiving the nose and a hole that generally aligns with the cavity in the nose; and a lock releasably received in the hole and the cavity for holding the wear member to the base, the lock having a front face that engages at least the undercut portion of the front surface of the cavity to resist ejection of the lock.

22. A wear assembly in accordance with claim 21 wherein the front face of the lock has a curved, concave configuration that generally conforms to the front surface of the cavity.

23. A wear assembly in accordance with claim 21 wherein the wear member includes a fulcrum and the lock engages and moves about the fulcrum between hold and release positions.

24. A wear assembly for excavating equipment comprising:

a base fixed to the excavating equipment and including a forwardly projecting nose, the nose having a cavity with a curved, convex front surface;

a wear member having converging walls that converge toward a narrow front end, side walls extending between the converging walls, a socket that opens in a rear end for receiving the nose, and a hole extending through one of the walls to generally align with the cavity in the nose; and a lock releasably received in the hole and the cavity for holding the wear member to the base, the lock having a front face extending generally in a direction that extends from one of the converging walls toward the other of the converging walls, the front face of the lock being concave and curved to complement the front surface of the cavity and thereby grip the front surface to resist ejection.

25. A wear assembly in accordance with claim 24 wherein the hole is formed in one of the converging walls.

26. A wear assembly in accordance with claim 24 wherein the hole is formed in one of the side walls.

27. A lock for releasably securing a wear member to excavating equipment, the lock comprising:

a body adapted to be releasably received through a hole in the wear member and into a cavity in a base fixed to the excavating equipment to thereby hold the wear member to the excavating equipment, the body including a front, curved concave face to engage a corresponding front surface of the cavity of the base to resist ejection of the lock;

pivot member spaced from the body or engaging a fulcrum about which the lock pivots between a hold position when the body is received into the cavity in the base to prevent release of the wear member from the base and a release position when the wear member can be released from the base; and an arm adapted to be spaced outside of the cavity in the base to couple the pivot member to the body.

28. A lock in accordance with claim 27 wherein the body includes a rear convex curved surface for abutting the wear member.

29. A lock in accordance with claim 27 in which the body includes a pair of rear bearing surfaces for abutting the wear member, wherein the rear bearing surfaces diverge in a forward direction.

30. A lock for releasably securing a wear member to excavating equipment, the lock comprising a body adapted to releasably hold the wear member to a base fixed to the excavating equipment, the body having a first portion adapted to be received into a cavity in the base and a second portion adapted to received in a hole in the wear member generally aligned with the cavity, the first portion having a front face shaped to engage and grip an opposing convex, curved surface within the cavity to resist ejection of the lock from the assembled wear member and base.

31. A lock in accordance with claim 30 wherein the front face of the first portion is concave and curved.

32. A wear assembly for excavating equipment comprising:

a base fixed to the excavating equipment and including a forwardly projecting nose;

a wear member comprising converging walls that converge toward a front end, side walls extending between the converging walls, a socket that opens in a rear end to receive the nose of the base, and a hole extending through one of the walls, the hole communicating with the socket and having a rear portion that includes a pair of forwardly-facing bearing surfaces, the bearing surfaces being inclined to diverge from each other in a forward direction; and a lock receivable in the hole and including rear bearing surfaces to abut the forwardly-facing bearing surfaces of the wear member to releasably hold the wear member to the base.

* * * * *

UNITED STATES PATENT AND TRADEMARK OFFICE

CERTIFICATE OF CORRECTION

PATENT NO. : 7,578,081 B2
APPLICATION NO. : 11/789549
DATED : August 25, 2009
INVENTOR(S) : James E. Bearden et al.

It is certified that error appears in the above-identified patent and that said Letters Patent is hereby corrected as shown below:

In Colummn 13, Line 10, “a” should be added before “pivot”.

Signed and Sealed this
Twenty-second Day of February, 2011

David J. Kappos

David J. Kappos
*Director of the United States Patent and Trademark Office*